US005482265A

United States Patent [19]

Nakazato et al.

[11] Patent Number: 5,482,265

[45] Date of Patent: Jan. 9, 1996

[54] SHEET FEEDER FOR AN IMAGE FORMING APPARATUS

[75] Inventors: Yasushi Nakazato, Tokyo; Hiroyuki Shibaki, Yokohama; Tetsuo Yamanaka, Kawasaki; Hiroshi Hosokawa, Yokohama, all of Japan

[73] Assignee: Ricoh Company, Ltd., Tokyo, Japan

[21] Appl. No.: 283,663

[22] Filed: Aug. 1, 1994

Related U.S. Application Data

[62] Division of Ser. No. 987,189, Dec. 8, 1992, abandoned.

[30] Foreign Application Priority Data

| | | | |
|---|---|---|---|
| Dec. 9, 1991 | [JP] | Japan | 3-324596 |
| Apr. 14, 1992 | [JP] | Japan | 4-094285 |
| Aug. 17, 1992 | [JP] | Japan | 4-217725 |
| Sep. 24, 1992 | [JP] | Japan | 4-254964 |
| Oct. 23, 1992 | [JP] | Japan | 4-286214 |

[51] Int. Cl.[6] ..... B65H 5/34

[52] U.S. Cl. ..... 271/242; 271/265.01; 271/270; 355/317

[58] Field of Search ..... 271/110, 111, 271/270, 265, 242, 265.1, 265.2; 355/316, 317

[56] References Cited

U.S. PATENT DOCUMENTS

| | | | |
|---|---|---|---|
| 5,104,110 | 4/1992 | Haibara | 271/270 X |
| 5,119,146 | 6/1992 | Nobumori | 271/270 X |
| 5,197,726 | 3/1993 | Nogami | 271/110 |
| 5,205,548 | 4/1993 | Yamada | 271/270 X |

FOREIGN PATENT DOCUMENTS

| | | |
|---|---|---|
| 0395003 | 10/1990 | European Pat. Off. . |
| 3416252 | 11/1984 | Germany . |
| 36049915 | 8/1986 | Germany . |
| 3717372 | 11/1987 | Germany . |
| 3932177 | 4/1991 | Germany . |
| 59-101382 | 6/1984 | Japan . |
| 1-236131 | 9/1989 | Japan . |

*Primary Examiner*—H. Grant Skaggs

*Attorney, Agent, or Firm*—Oblon, Spivak, McClelland, Maier & Neustadt

[57] ABSTRACT

A sheet feeder incorporated in an image forming apparatus and allowing the distance between the preceding sheet and the succeeding sheet to be reduced to a minimum necessary one. A pair of control rollers whose transport speed is controllable are located upstream of an image forming section with respect to an intended direction of sheet transport. An image transfer and paper separation unit is located at the image forming section. The transport speed of the control rollers is made higher than an image forming speed for any desired period of time after the leading edge of a sheet has been gripped by said control rollers and before the leading edge reaches the image forming section. As a result the distance between the preceding and succeeding sheets is reduced to increase the number of images which can be formed for a unit time without the transport speed at the image forming section being increased.

11 Claims, 25 Drawing Sheets

SHEET FEEDER FOR AN IMAGE FORMING APPARATUS

This application is a Division of application Ser. No. 07/987,189, filed on Dec. 8, 1992, now abandoned.

BACKGROUND OF THE INVENTION

The present invention relates to a sheet feeder applicable to various kinds of sheet processing apparatuses and, more particularly, to a sheet feeder incorporated in a laser printer, copier, facsimile transmitter or similar image forming apparatus for feeding cut sheets continuously.

An image forming apparatus of the kind described includes a sheet feeder for feeding a sheet to record an image formed on a photocnductive element or similar image carrier. Usually, the sheet feeder has a sheet cassette loaded with a stack of sheets, a pick-up roller for picking up the uppermost sheet of the stack, and a grip roller pair to which the sheet picked up is driven via a feed roller and a separation roller facing each other. The sheet transported by the grip roller abuts against a register roller pair with the leading edge thereof sensed by a register sensor. As a result, the movement of the sheet is stopped for a moment to synchronize the sheet to the start of image formation. On the start of image formation, the register roller pair starts rotating to thereby drive the sheet to an image transfer section. Consequently, an image is transferred from the photoconductive element to the sheet. Such a conventional sheet feeder transports a sheet at a substantially constant speed at all times in synchronism with the image forming speed of the apparatus. On the other hand, a sheet feeder capable of changing the transport speed is disclosed in, for example, Japanese Patent Laid-Open Publication No. 236131/1989. In this type of sheet feeder, even when the interval or distance between consecutive sheets changes due to, for example, the irregular positions of sheets in the stack or the slippage occurred in the event of sheet transfer, the transport speed of the following sheet is increased to compensate for the increase in the interval. This is successful in eliminating a sheet jam ascribable to a change in the interval between sheets.

With a conventional analog copier, it is necessary to scan a document every time an image is to be formed. This, of course, requires a substantial distance between the preceding and succeeding sheets. Regarding a page printer or a facsimile printer using plain sheets, reducing the distance between consecutive sheets, has not been discussed much since an image processing time is needed before the next printing. However, there is an increasing demand for an implementation capable of reducing the interval between sheets as far as possible to cope with a digital copier and a high speed and efficient image forming device incorporated in a printer or a facsimile.

This demand, however, cannot be met by the conventional sheet feeder. Specifically, the preceding sheet is temporarily brought to a stop by the register roller pair after it has been fully transported and is driven again in synchronism with the image formation. This kind of control is not practicable unless a sufficient interval is provided between consecutive sheets. In addition, since the sheets are each abutted against the register roller pair, the distance between the trailing edge of the preceding sheet and the leading edge of the following sheet increases, i.e., it becomes greater than at the time of the start of sheet feed. Moreover, while the sheets are transported from the stack to the register roller pair, the distance between them is noticeably effected by the irregular positions in the stack, the irregular rotation speeds and aging of the rollers, the irregular positions of the rollers, the slippage of the sheets on the rollers, the deformation of the sheets on the transport path, the error of the sensor, etc. Hence, it is necessary to provide a distance between sheets great enough to compensate for such irregularities at the start of sheet feed. More specifically, since images are continuously formed with a sufficient interval matching the irregularities and the registration time provided between consecutive sheets, an interval as great as 30% to 50% of the sheet length is simply wasted, as measured at the image forming section.

The problems described above are also true with the conventional sheet feeder disclosed in the above-mentioned Japanese Patent Laid-Open Publication No. 236131/1989. Specifically, when the interval between sheets is increased due to the irregularities, the sheet feeder accelerates the rotation of a control roller and other rollers for a predetermined period of time to thereby correct, i.e., reduce the interval. This maintains the interval between sheets constant and allows sheets to be fed with accuracy. However, the sheet feeder causes the sheet having been corrected to abut against the register roller remaining in a stop so as to position the leading edge of the sheet and correct skew, and then drives it again in synchronism with an image formed at the image forming section. As a result, the interval between the sheets sequentially transported to the image forming section is great.

In the light of the above, Japanese Patent Laid-Open Publication No. 8756/1988, for example, proposes an arrangement wherein two pairs of register rollers and transport paths each being associated with one of the two roller pairs are provided. The register roller pairs and the transport paths are switched over to reproduce images continuously without providing an interval between consecutive sheets. Although this approach is capable of surely transporting sheets with conventional control accuracy, it needs a complicated mechanism for selectively feeding a sheet to either of the two register roller pairs. This not only increases the cost but also makes the sheet feeder bulky and unreliable. Further, Japanese Patent Laid-Open Publication No. 130944/1987 teaches a sheet feeder having at least one continuously operable sheet transporting means between sheet separating and feeding means and a photoconductive element. The sheet transporting means is provided with a relatively low transport speed, so that sheets continuously fed from a stack without any interval may be spaced apart by an adequate distance at an image forming section. This type of sheet feeder synchronizes a sheet and an image formed on a photoconductive element by using a roller rotating continuously and an output of a sensor in place of the abutment of the leading edge of a sheet against a register roller pair. However, the problem with such a scheme is that the sheet separating and feeding means cannot operate stably due to, for example, changes in the positions of individual sheets of a stack, the separating force acting on the sheets, and the friction acting on the sheets. This makes it difficult to feed sheets continuously without providing a substantial distance therebetween. Any irregularity occurring in the sheet separating and feeding means directly translates into a dislocation of an image relative to a sheet, degrading the image quality.

SUMMARY OF THE INVENTION

It is, therefore, an object of the present invention to provide a sheet feeder capable of reducing the distance between consecutive sheets to minimum necessary one and feeding sheets continuously and stably while maintaining the minimum necessary distance with accuracy.

It is another object of the present invention to provide a sheet feeder capable of increasing the number of images to be formed by an image forming apparatus for a unit time without increasing a sheet transport speed at an image forming section included in the apparatus.

In accordance with the present invention, a sheet feeder for continuously feeding cut sheets to a sheet processing section of a sheet processing apparatus comprises control rollers adjoining the sheet processing section on the upstream side with respect to a the intended direction of sheet transport for transporting the sheets to the sheet processing section at a desired transport speed, and control means for accelerating the control rollers to a high speed higher than a sheet processing speed for a desired period of time after the leading edge of the sheet has been gripped by the control rollers and before it reaches the sheet processing section to thereby reduce the distance between the preceding sheet and the succeeding sheet

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, a reference will be made to conventional sheet feeders.

Referring to FIGS. 30A–30D, a conventional sheet feeder using a friction reverse roller (FRR) is shown. Rollers included in the sheet feeder are each rotated in a direction indicated by an arrow. FIG. 31 is a diagram useful for understanding the operation of the sheet feeder.

Figure 30A:
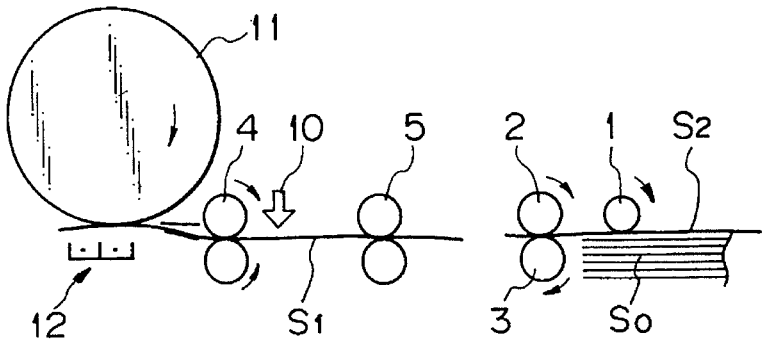
Fig. 30A PRIOR ART
FIGS. 30A, 30B, 30C and 30D are sections showing a conventional sheet feeder using a friction reverse roller.
Figure 30B:
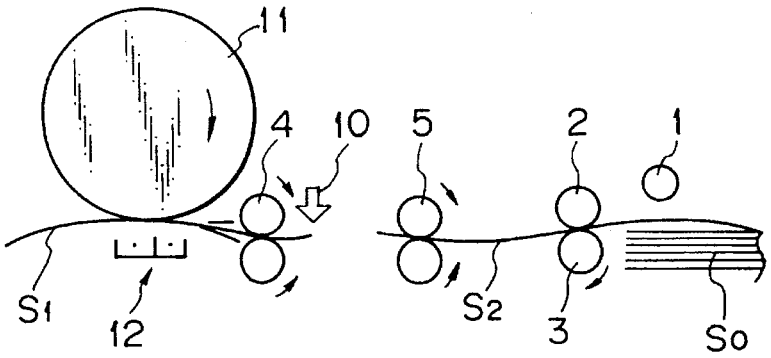
Fig. 30B PRIOR ART
Figure 30C:
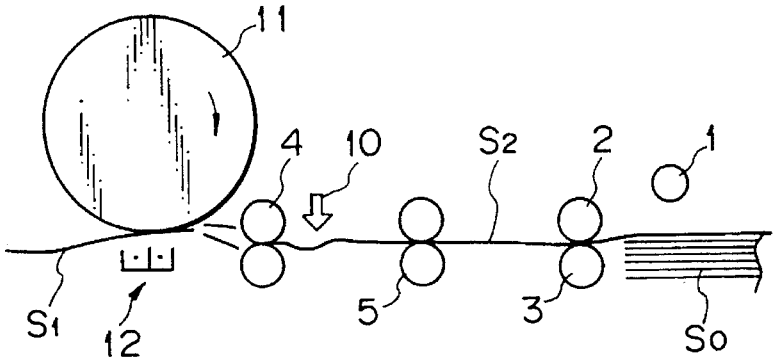
Fig. 30C PRIOR ART
Figure 30D:
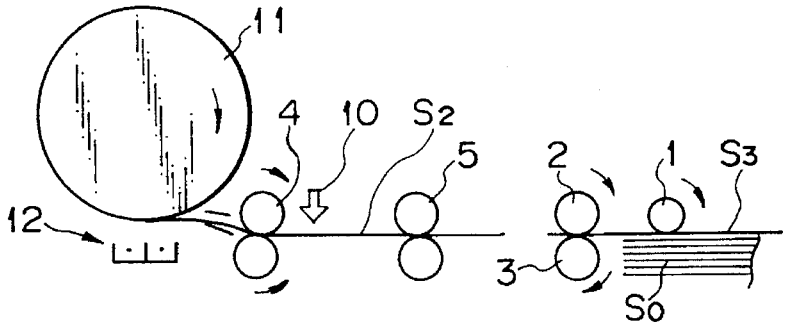
Fig. 30D PRIOR ART
Figure 31:
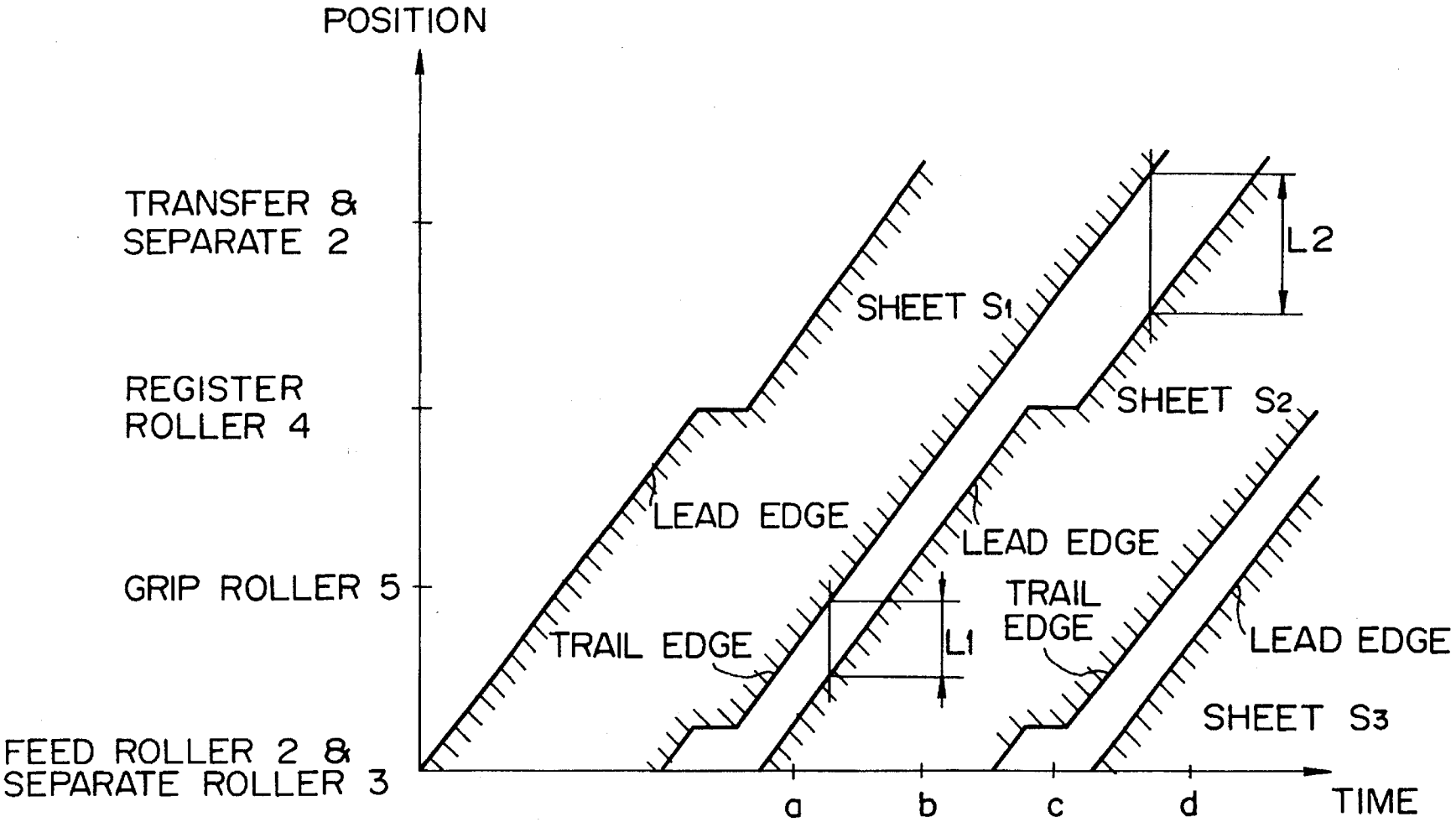
Fig. 31 PRIOR ART
FIG. 31 is a diagram associated with FIG. 30.

As shown in FIG. 30A, after the trailing edge of a sheet $S_1$ has been sufficiently fed to the left as viewed in the figure, a sheet $S_2$ on the top of a sheet stack $S_0$ is driven by a pick-up roller 1 to a feed roller 2. The feed roller 2 further drives the sheet $S_2$ to a grip roller 5. To prevent two or more sheets from being fed together, a separation roller 3 is located to face the feed roller 2 and applied with a predetermined torque in a direction for urging the sheet $S_2$ backward, as indicated by an arrow in the figure. As shown in FIG. 30B, as soon as the grip roller 5 grips the leading edge of the sheet $S_2$, the pick-up roller 1 is retracted to a position where it does not contact the uppermost sheet $S_2$. At the same time, the drive acting on the feed roller 2 is interrupted to make it idle. As a result, the sheet $S_2$ is transported by the grip roller 5. Then, as shown in FIG. 30C, the leading edge of the sheet $S_2$ abuts against a register roller 4 which is in a stop. As a register sensor 10 senses the leading edge of the sheet $S_2$, the register roller 4 temporarily stops the sheet $S_2$ to synchronize it with the start of image formation in response to the output of the sensor 10. As shown in FIG. 30D, on the start of image formation, the register roller 4 starts rotating to drive the sheet S2 into an image transfer section where a photoconductive element 11 and an image transfer and paper separation unit 12 are located. At this instant, the drive acting on the grip roller 5 is interrupted to make it idle.

In the above construction, the transport speed is maintained substantially constant and synchronous with the image forming speed. A drive mechanism for sheet transport included in the sheet feeder is implemented only by a constant speed drive source and clutches or similar drive connecting means.

Figure 32:
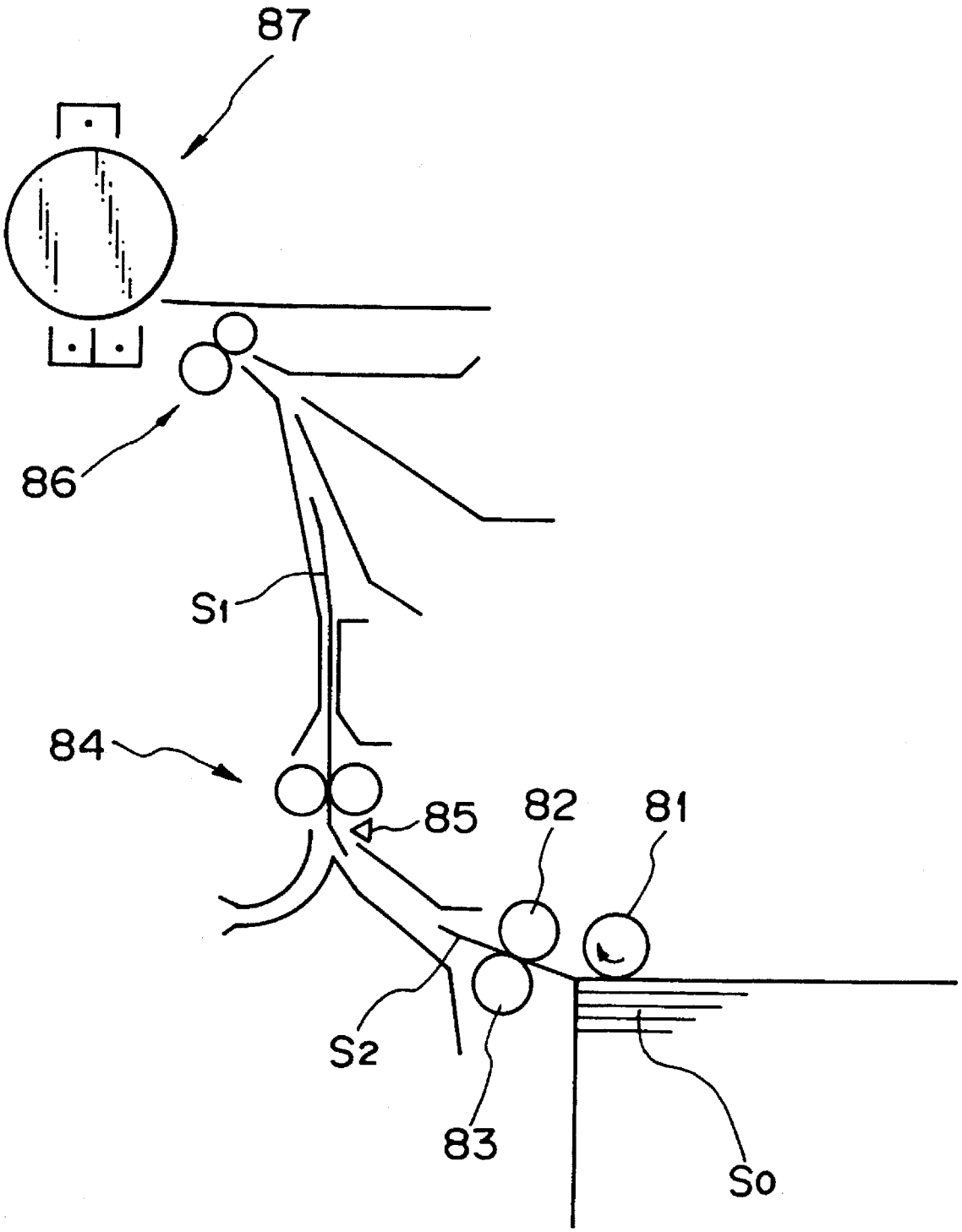
Fig. 32 PRIOR ART
FIG. 32 is a section showing a conventional sheet feeder capable of changing a transport speed.

FIG. 32 shows a conventional sheet feeder capable of changing the sheet transport speed, i.e., the sheet feeder disclosed in previously stated Japanese Patent Laid-Open Publication No. 236131/1989. As shown, a sheet $S_1$ is picked up by a pick-up roller 81 and then separated from the other sheets by a feed roller 82 and a separation roller 83. The interval between the sheet $S_1$ and the next sheet $S_2$ is determined on the basis of time when the trailing edge of the sheet $S_1$ moves away from a control roller 84 and the time when the leading end of the following sheet S2 reaches a sensor 85. When the interval is greater than a predetermined one, the control roller 84 and the rollers preceding it in the direction of sheet transport are each driven at, for example, a five times higher speed to reduce the interval between the sheets $S_1$ and $S_2$. On the elapse of a predetermined period of time, the control roller 84, as well as the other rollers, is decelerated to the usual speed to transport the sheet S2 toward a register roller 86. The register roller 86 once stops the sheet S2 and then drives it at a predetermined timing toward an image forming section 87. In this construction, even when the interval between consecutive sheets changes due to, for example, the irregular positions of the sheets $S_1$ and $S_2$ in the stack or the slippage occurred in the event of sheet transfer, the transport speed of the following sheet $S_2$ is increased to compensate for the increase in the interval. This is successful in eliminating a sheet jam ascribable to the irregularity in the interval between consecutive sheets.

There is an increasing demand for an implementation capable of reducing the interval between sheets as far as possible to cope with a digital copier and a high speed and efficient image forming device incorporated in a printer or a facsimile. This demand, however, cannot be met by the conventional sheet feeder shown in FIGS. 30A–30D. Specifically, the preceding sheet $S_1$ is temporarily brought to a stop by the register roller 4 after it has been fully transported and is driven again in synchronism with the image formation. This kind of control is not practicable unless a sufficient interval is provided between sheets. In addition, since the sheets $S_1$ and $S_2$ are each abutted against the register roller 4, the distance between the trailing edge of the preceding sheet $S_1$ and the leading edge of the following sheet $S_2$ increases from L1 to L2 as shown in FIG. 31, i.e., it becomes greater than at the time of the start of sheet feed. Moreover, while the sheets $S_1$ and $S_2$ are transported from the stack to the register roller 4, the distance between them is noticeably effected by the irregular positions in the stack, the irregular rotation speeds and aging of the rollers, the irregular positions of the rollers, the slippage of the sheets $S_1$ and $S_2$ on the rollers, the deformation of the sheets $S_1$ and $S_2$ on the transport path, the error of the sensor 10, etc. Hence, it is necessary to provide a distance between sheets great enough to compensate for such irregularities at the start of sheet feed. More specifically, since images are continuously formed with a sufficient interval matching the irregularities and the registration time provided between consecutive sheets, an interval as great as 30% to 50% of the sheet length is simply wasted as measured at the image forming section.

The problems described above are also true with the conventional sheet feeder shown in FIG. 32. Specifically, when the interval between sheets is increased due to the irregularities, the sheet feeder accelerates the rotation of the control roller 84 and other rollers for a predetermined period of time to thereby correct, i.e., reduce the interval. This maintains the interval between sheets constant and allows sheets to be fed with accuracy. However, the sheet feeder causes the sheet having been corrected to abut against the register roller 86 remaining in a stop so as to position the leading edge of the sheet and correct skew, and then drives it again in synchronism with an image formed at the image forming section. As a result, the interval between the sheets $S_1$ and $S_2$ sequentially transported to the image forming section is great.

Although some elaborated devices are disclosed in previously stated Japanese Patent Laid-Open Publication Nos. 8756/1988 and 130944/1987 to eliminate the above problems, they are not fully satisfactory.

Preferred embodiments of the sheet feeder in accordance with the present invention will be described which insure accurate and stable continuous sheet feed while reducing the interval between consecutive sheets.

FIGS. 1A–1D show a sheet feeder embodying the present invention in consecutive steps of sheet feed. FIG. 2 shows an image forming apparatus incorporating the embodiment and implemented as a laser printer by way of example.

As shown in FIG. 2, the laser printer has a printer body 15, a two-sided copy unit 16, a sheet feed unit 17, and a sheet discharge unit 34. The two-sided copy unit 16 and sheet feed unit 17 are incorporated in a single table 18 which is connected to the printer body 15. The sheet discharge unit 34 is mounted on the top of the printer body 15. A photoconductive element in the form of a drum 11 is disposed in the printer body 15. On the start of an image forming process, the drum 11 is rotated by a motor, not shown, in a direction indicated by an arrow. A main charger 29 is located above the drum 11 and uniformly charges the surface of the drum 11 being rotated. An optical writing unit 30 scans the charged surface of the drum 11 in the axial direction of the latter with a laser beam having been modulated on the basis of image data. As a result, a latent image is electrostatically formed on the drum 11. A developing unit 31 deposits a toner on the latent image to convert it to a toner image.

Trays 36 and 37 form respectively part of an upper and a lower stage of a sheet feeder incorporated in the printer body 15. Pick-up rollers 1*a* and 1*b* are associated with the trays 36 and 37, respectively. Likewise, a pick-up roller 1*c* is associated with the sheet feed unit 17. As any one of the pick-up rollers 1*a*–1*c* is rotated, a sheet is fed from associated one of the trays 36 and 37 and sheet feed unit 17 and then caused to abut against a control roller 6 which is held in a stop then. The control roller 6 is made up of a pair of rollers arranged one above the other in the vicinity of the drum 11 and has a registering function. The control roller 6 starts rotating in synchronism with the rotation of the drum 11 carrying the toner image thereon, thereby feeding the sheet to an image forming section. An image transfer and paper separation unit 12 is located at the image forming section and includes a transfer charger. After the toner image has been transferred from the drum 11 to the sheet by the transfer charger, the sheet is separated from the drum 11. Then, the sheet is transported to a fixing unit 49 by a belt 48 to have the toner image fixed thereon by heat.

Subsequently, the sheet, or printing, is steered by a reversible switching roller 21 to one of an openable stacker 22 mounted on the rear of the printer body 15, the sheet discharge unit 34, and the two-sided copy unit 16. There are also shown in the figure a transport roller pair 23 disposed in the printer body 15, transport roller pairs 24 disposed in the sheet discharge unit 34, and discharge rollers 25*a* and 25*b* for discharging sheets from the sheet discharge unit 34 to a lower tray 34*a* and an upper tray 34*b*, respectively. A register sensor 10 immediately precedes the control roller pair 6 for sensing a sheet. A cleaning unit 44 removes the toner remaining on the drum 11 after the image transfer while a discharge lamp 26 dissipates the charge also remaining on the drum 11 after the image transfer. The drum 11 initialized by the cleaning unit 44 and discharge lamp 26 is again brought to the main charger for repeating the above procedure.

Further, the printer body 15 has thereinside the boards of a controller 27 and the board of an engine driver 28. The controller 27 controls the entire laser printer as well as print data processing while the engine driver 28 controls a printer engine constituting the image forming section.

Figure 3:
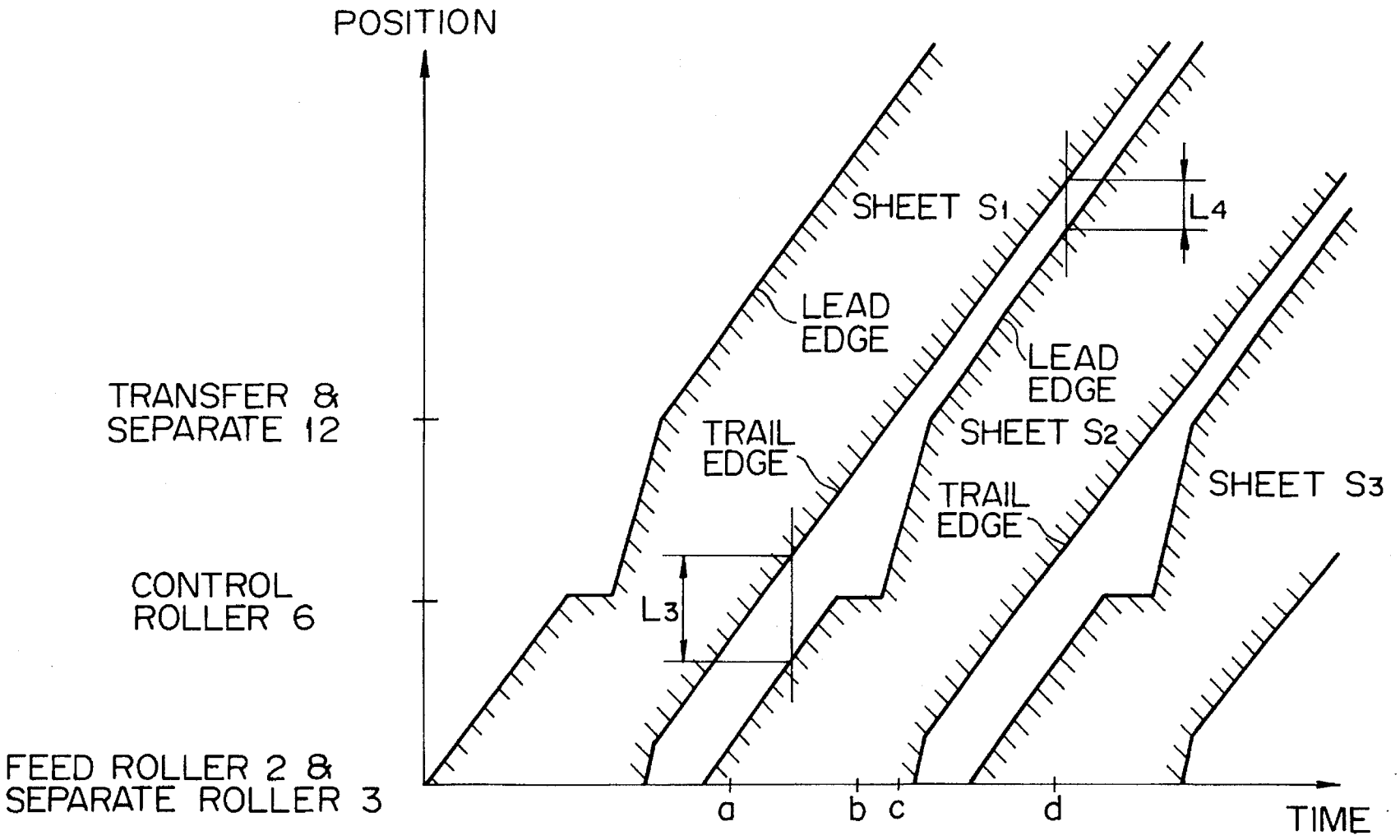
FIG. 3 is a diagram representative of sheet feed by the embodiment.

The operation of the embodiment will be described specifically with reference to FIGS. 1A–1D. In these figures, an arrow attached to each roller indicates the direction and speed of a driving force; a single arrow indicated by a solid line is representative of a usual image forming speed while two arrows indicates a speed twice or more as high as the usual speed. FIG. 3 is a diagram associated with the sequence of steps shown in FIGS. 1A–1D.

The sheet feeder incorporated in the laser printer is of the type feeding cut sheets continuously. The control rollers 6 capable of controlling the sheet transport speed are located on the sheet transport path upstream (right-hand side as viewed in the figures) of the image forming section, i.e., image transfer and paper separation unit 12. A control means **6*a* schematically illustrated in FIG. 1A can be utilized to control the speed of the control roller 6. The sheet transport speed of the control rollers 6 is made higher than the image forming speed (equal to the sheet transport speed as measured at the image forming section) for any suitable period of time after the leading edge of a sheet has been gripped by the control rollers 6** and before it reaches the image forming section. As a result, the distance between the preceding and succeeding sheets is reduced.

Figure 1A:
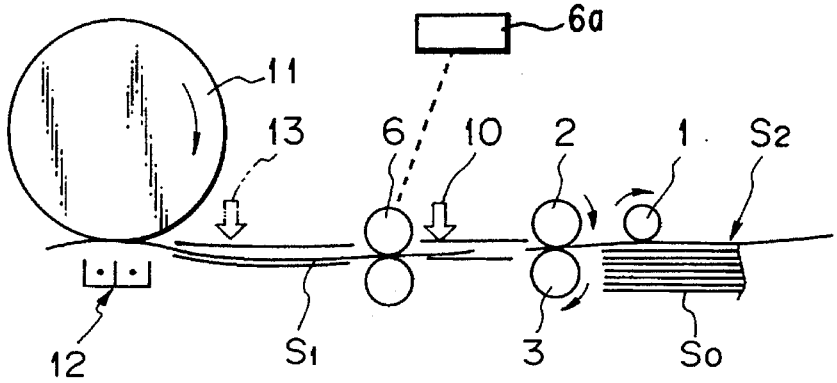
FIGS. 1A, 1B, 1C and 1D show a sheet feeder embodying the present invention at a sequence of stages of operation.
Figure 1B:
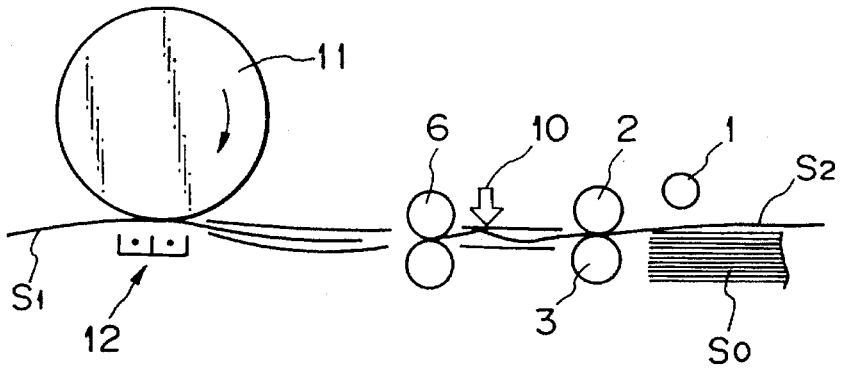
Figure 1C:
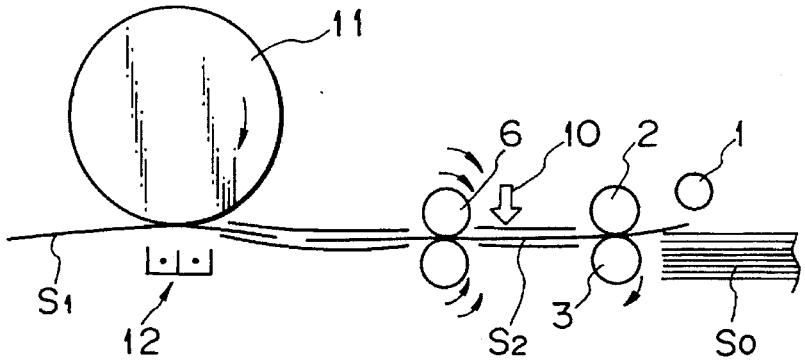
Figure 1D:
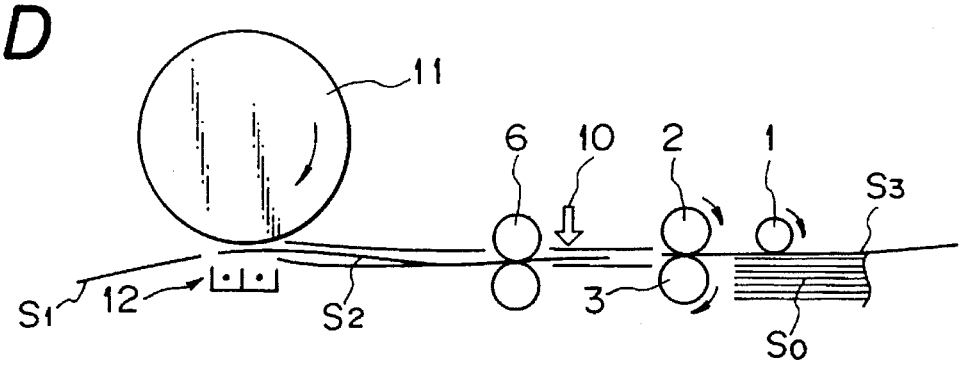
Figure 2:
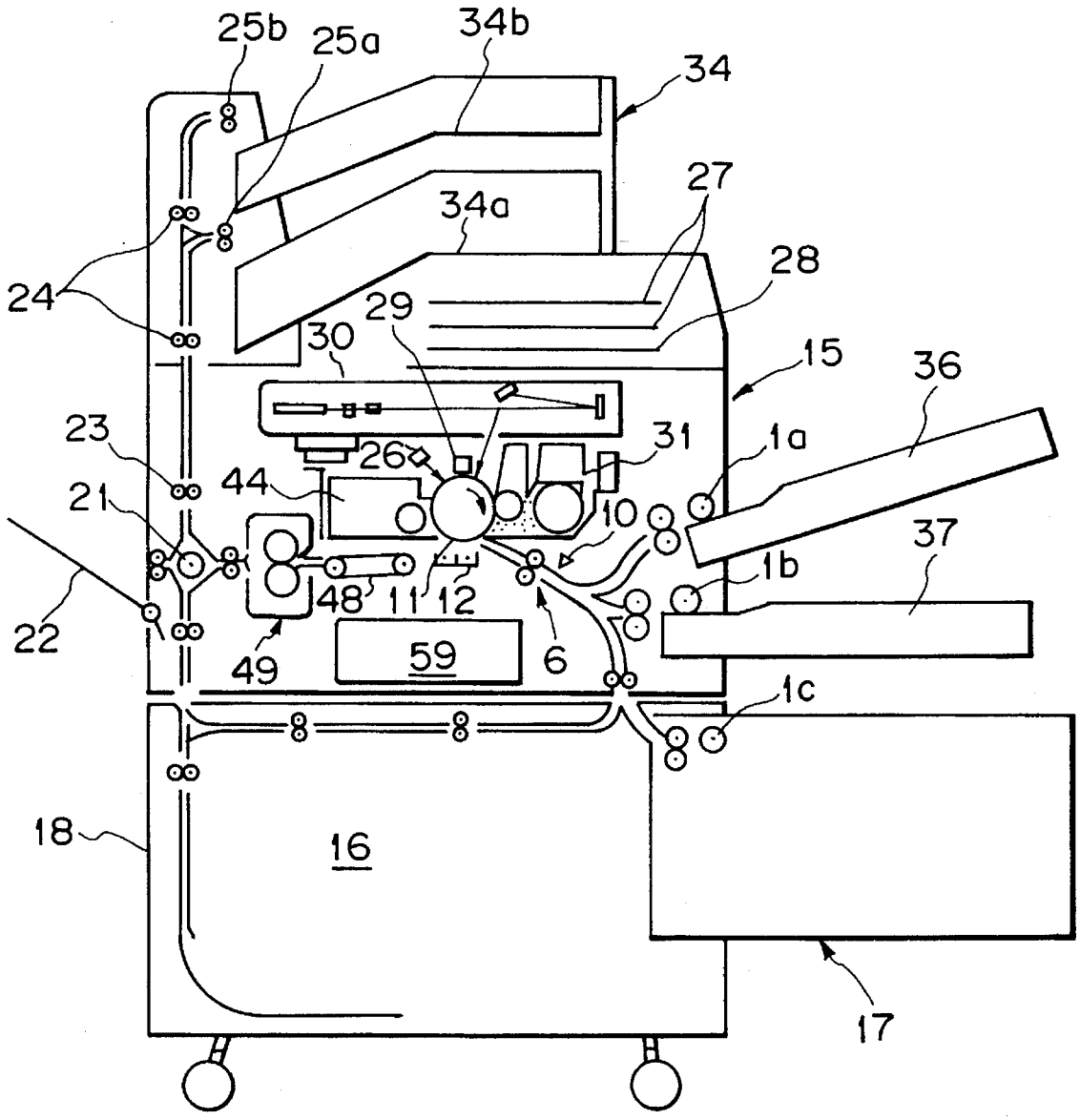
FIG. 2 shows an image forming apparatus incorporating the embodiment of FIGS. 1A–1D and implemented as a laser printer.

As shown in FIG. 1A, after the trailing edge of a sheet $S_1$ has been sufficiently fed away from the tray 36 or 37 or the sheet feed unit 17, FIG. 2, a sheet $S_2$ on the top of a sheet stack $S_0$ is driven by a pick-up roller 1 to a feed roller 2. The feed roller 2 further drives the sheet S2 to the control rollers 6. To prevent two or more sheets from being fed together, a separation roller 3 is located to face the feed roller 2 and applied with a predetermined torque in a direction for urging the sheet $S_2$ backward, as indicated by an arrow in the figure. As shown in FIG. 1B, as soon as the control rollers 6 grip the leading edge of the sheet $S_2$, the pick-up roller 1 is retracted to a position where it does not contact the uppermost sheet $S_2$. The sheet $S_2$ is caused to abut against the control rollers 6 which are held in a halt then. As the register sensor 10 senses the leading edge of the sheet $S_2$, the control rollers 6 temporarily stop the sheet S2 for synchronizing it with the start of image formation in response to the output of the sensor 10. As shown in FIG. 1C, on the start of image formation, the control rollers 6 are driven at a higher speed to reduce the distance between the preceding sheet $S_1$ and the succeeding sheet $S_2$. Subsequently, the control rollers 6 are decelerated to a speed equal to image forming speed and continuously transport the sheet $S_2$. At this instant, the drive acting on the feed roller 2 is interrupted to make it idle. As shown in FIG. 1D, the sheet $S_2$ is driven into the image forming section where the drum 11 and image transfer and sheet separation unit 12 are located. Increasing the rotation speed of the control rollers 6 as stated above is successful in reducing the interval between the trailing edge of the sheet $S_1$ and the leading edge of the sheet $S_2$ from L3 to L4, as shown in FIG. 3. As a result, a wasteful interval and, therefore, wasteful part of the image forming operation is eliminated. In addition, the illustrative embodiment has no sheet transport rollers between the control rollers 6 and the drum 11. This reduces the number of parts and, therefore, the oversize size and cost of the sheet feeder.

To insure stable sheet feed, the control rollers 6 should preferably be driven by a stepping motor whose speed is variable. Specifically, stable sheet transport is achievable if the step angle of the stepping motor is reduced as far as possible or if the electric driving method is implemented with microstep drive.

As indicated by a phantom line in FIG. 1A, a timing sensor, e.g., a reflection type photosensor 13 may be located in a position immediately preceding the drum 11 for sensing the leading edge of the sheet driven at the high speed by the control rollers 6. Then, the duration of the high speed rotation of the control rollers 6 or the transport speed may be adjusted on the basis of the output of the sensor 13 such that the sheet meets the image on the drum 11 with greater accuracy.

FIGS. 4A–4D show an alternative embodiment of the present invention in which a transport roller 7 intervenes between the control rollers 6 and the drum 11. It is to be noted that the constituents of this embodiment corresponding to those of the previous embodiment are designated by the same reference numerals, and that the arrows have the previously mentioned meaning. The transport roller 7 forms part of the image forming section. The timing sensor 13 is located to immediately precede the transport roller 7. The transport roller 7 and timing sensor 13 promote more stable image formation.

Figure 4A:
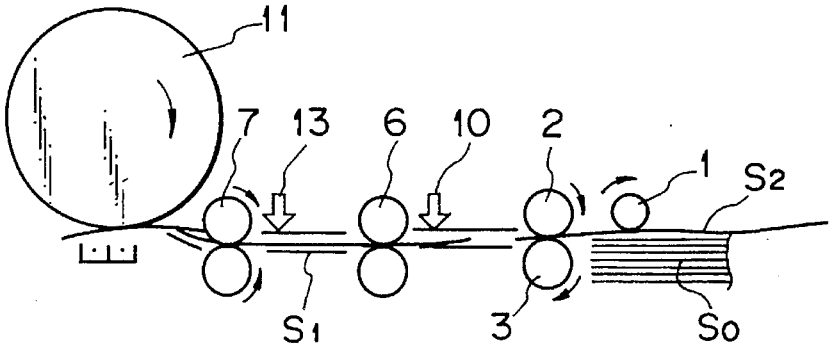
FIGS. 4A, 4B, 4C and 4D are sections showing an alternative embodiment of the invention.
Figure 4B:
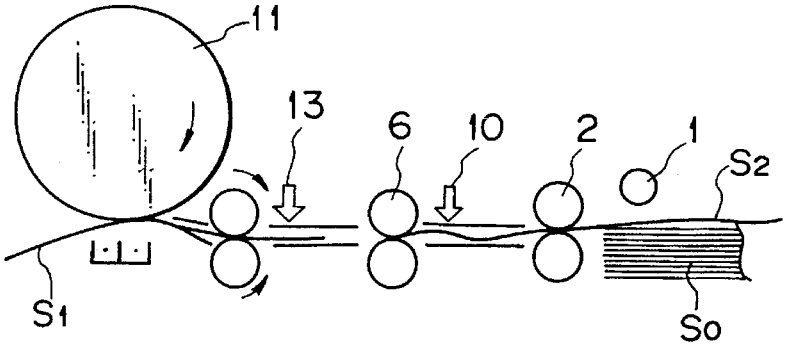
Figure 4C:
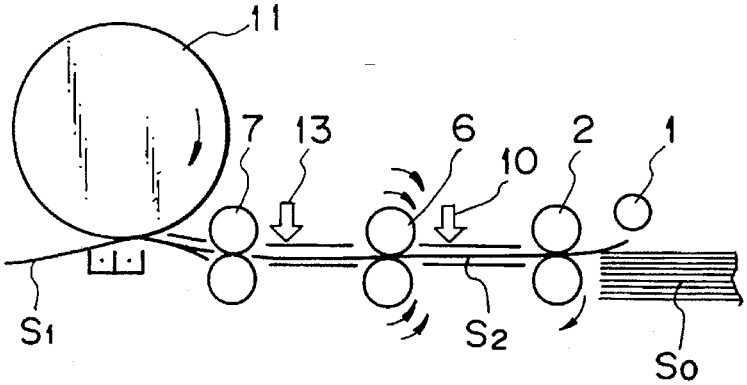
Figure 4D:
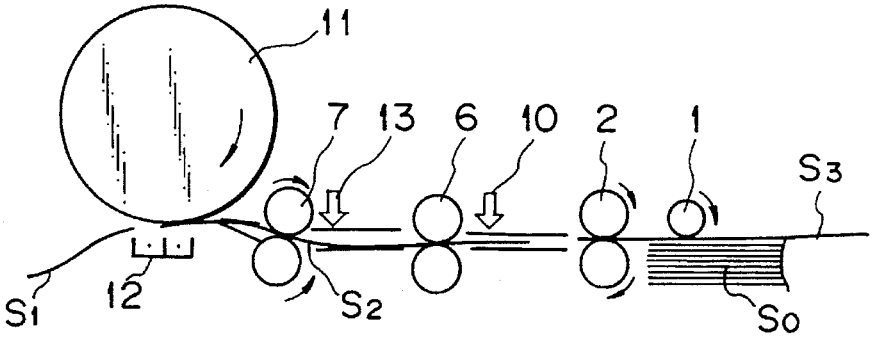
Figure 5:
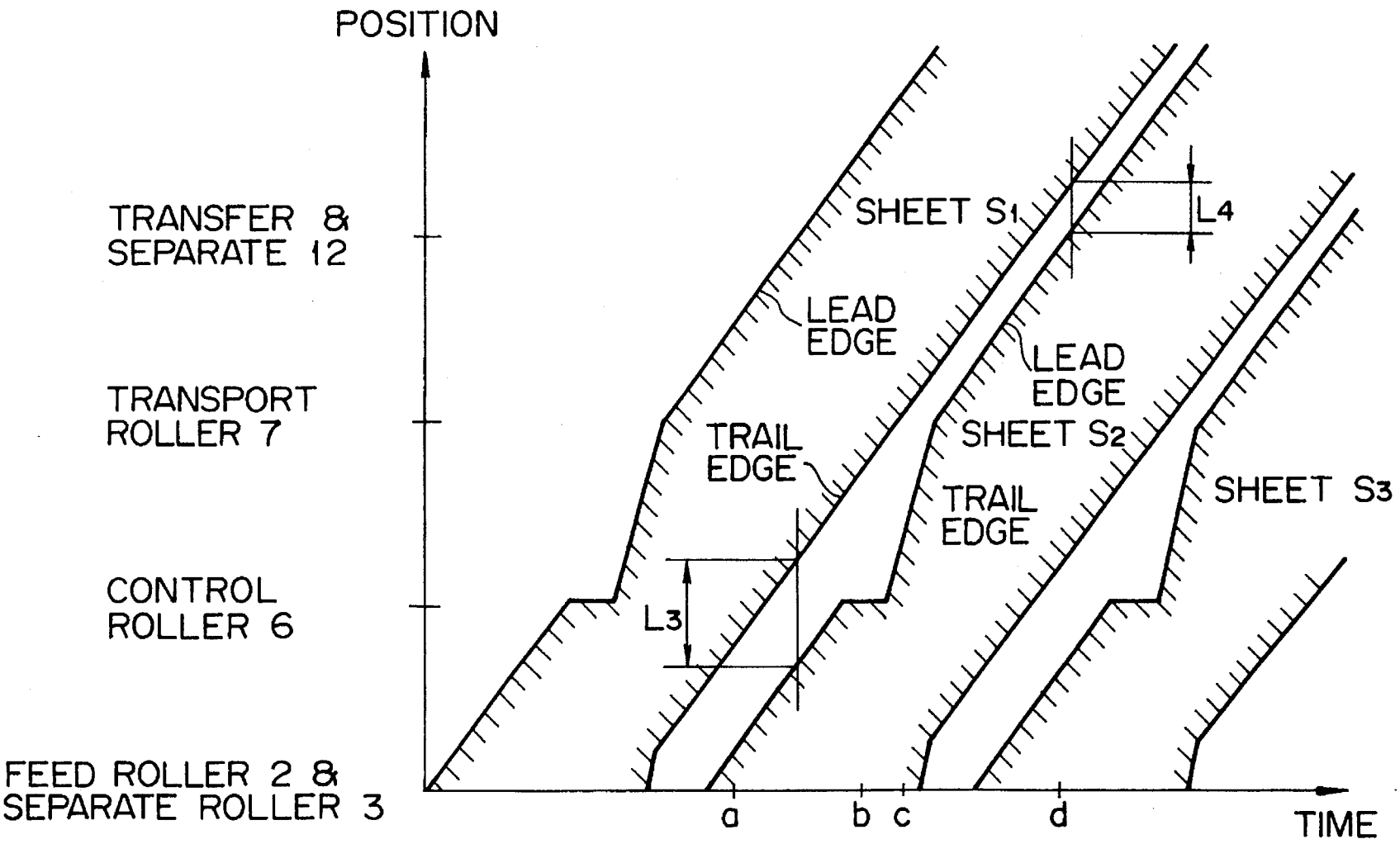
FIG. 5 is a diagram associated with the embodiment of FIGS. 4A–4D.

Specifically, as shown in FIG. 4A, the pick-up roller 1 is rotated in contact with the uppermost sheet $S_2$ of the sheet stack $S_0$ so as to feed it to the feed roller 2. The feed roller 2 separates the sheet $S_2$ in cooperation with the separation roller 3. After the trailing edge of the sheet $S_1$ preceding the sheet $S_2$ has been sufficiently transported, the sheet $S_2$ and successive sheets are transported one after another. As shown in FIG. 4B, the leading edge of the sheet $S_2$ is brought into abutment against the control rollers 6 remaining in a halt (assume that the preceding sheet $S_1$ has already reached the image forming section). As a result, the sheet $S_2$ is temporarily stopped for the synchronization thereof with the start of image formation. As shown in FIG. 4C, on the start of image formation, the control rollers 6 are rotated at the high speed to transport the sheet $S_2$ toward the transport roller 7 while reducing the distance between it and the preceding sheet $S_1$. Subsequently, the control rollers 6 are decelerated to coincide with the image forming speed and drives the sheet $S_2$ to the transport roller 7. At this instant, the drive acting on the teed roller 2 is interrupted to make it idle. Thereafter, the sheet transport speed is determined by the rotation of the transport roller 7 based on the output of the timing sensor 13 and corresponding to the image transport of the drum 11. As shown in FIG. 4D, the transport roller 7 moves the leading edge of the sheet $S_2$ to the image forming station where the drum 11 and image transfer and paper separation unit 12 are located. As shown in FIG. 5, the distance between the trailing edge of the sheet $S_1$ and the leading edge of the sheet $S_2$ is reduced from L3 to L4, as in the previous embodiment.

This embodiment is also successful in setting up a minimum necessary distance between consecutive sheets.

Figure 6A:
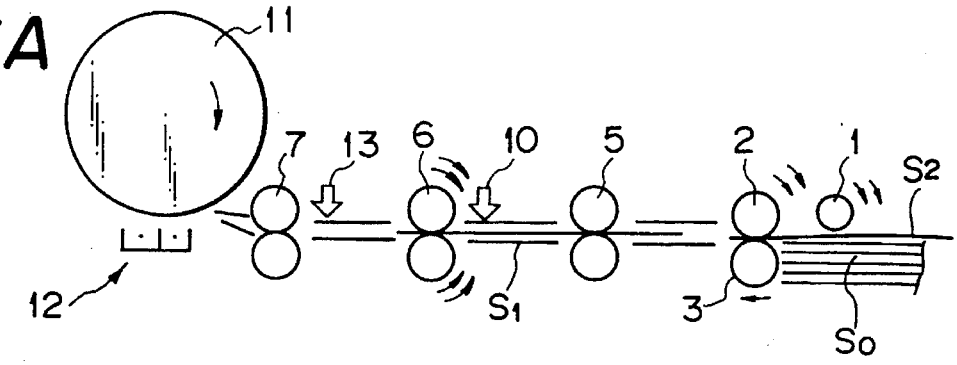
FIGS. 6A, 6B, 6C and 6D are sections showing another alternative embodiment of the invention.
Figure 6B:
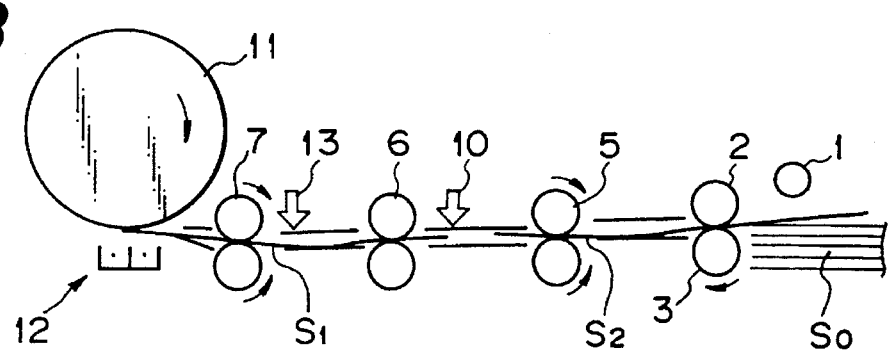
Figure 6C:
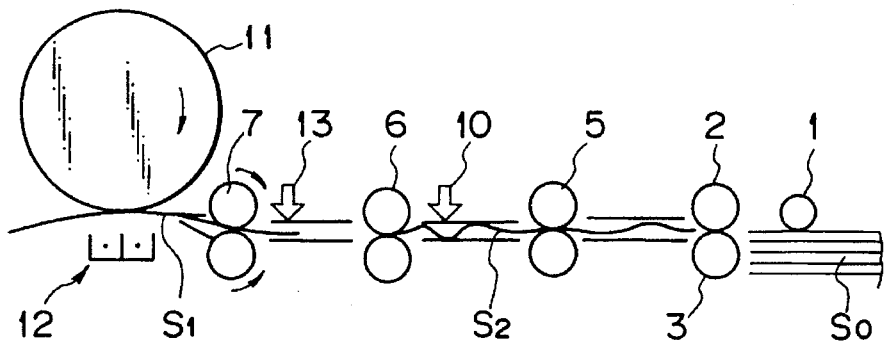
Figure 6D:
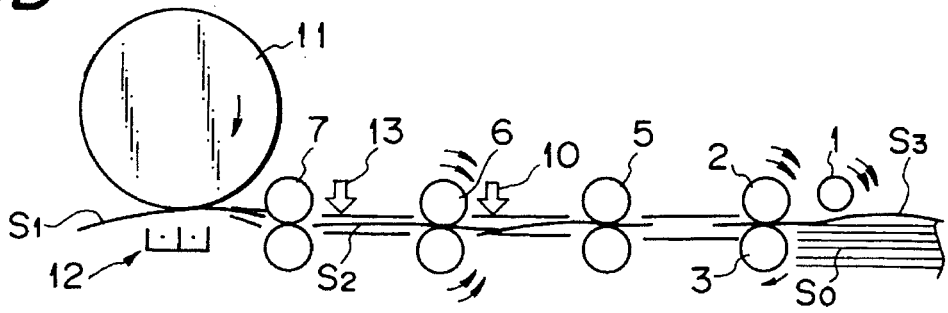
Figure 7:
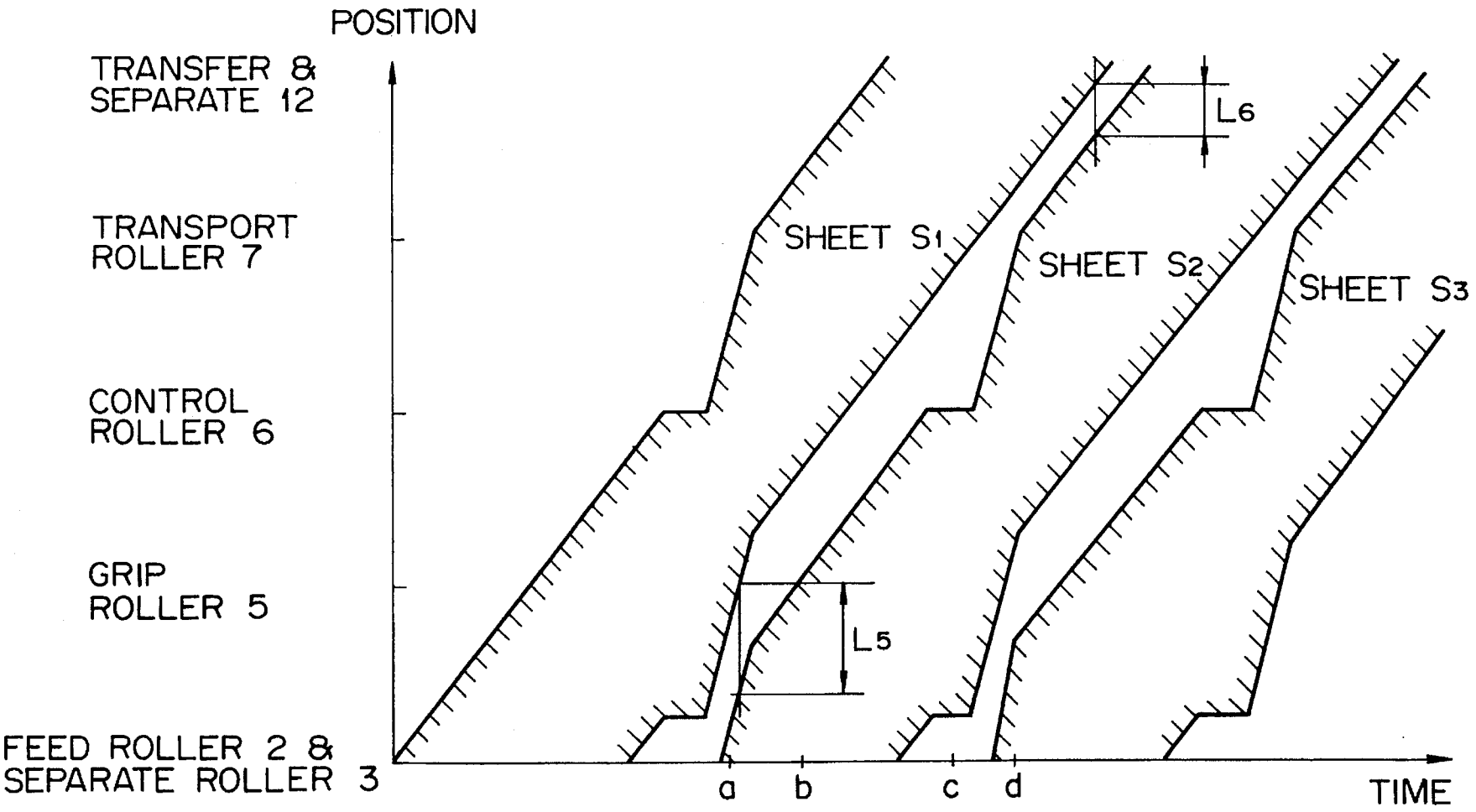
FIG. 7 is a diagram associated with FIGS. 6A–6D.

Referring to FIGS. 6A–6D, another alternative embodiment of the invention is shown which includes a grip roller 5. In FIGS. 6A–6D, the constituents corresponding to those shown in FIGS. 4A–4D are designated by the same reference numerals, and the arrows have the previously mentioned meaning. FIG. 7 is a diagram associated with the sequence of steps shown in FIGS. 6A–6D. The grip roller 5 is interposed between the separation roller 3 and the control roller 6. The load increases as the rotation of the separation roller 3 being rotated as indicated by an arrow in FIG. 6A is transferred via the sheet. The grip roller 5 functions to reduce such a load. In such an arrangement, the transport path is long. Therefore, assuming that a sheet is transported along the path at a relatively low speed, it may occur that the distance between the sheets $S_1$ and $S_2$ cannot be reduced to a desired one when the sheet $S_2$ is simply transported at the high speed over the relatively short distance between the control roller 6 and the transport roller 7. This embodiment includes a measure against such an occurrence, as follows.

As shown in FIG. 6A, after the sheet $S_1$ fed out from the stack $S_0$ has been fully transported, the uppermost sheet $S_2$ of the stack $S_0$ is driven toward the feed roller 2 by the pick-up roller 1. The separation roller 3 is applied with a predetermined torque to urge the sheet accompanying the sheet $S_2$ backward, as in the previous embodiments. At this time, the preceding sheet $S_1$ is being transported at the high speed by the control roller 6. Hence, to prevent the distance between the sheets $S_1$ and $S_2$ from increasing, the pick-up roller 1 and feed roller 2 are driven at a speed substantially equal to the transport speed of the preceding sheet $S_1$. As shown in FIG. 6B, when the transport roller 7 lowers the transport speed of the sheet $S_1$ to the same speed as the image transport speed of the drum 11, the following sheet $S_2$ is also decelerated and continuously driven by the grip roller 5. At this instant, the pick-up roller 1 having been rotated at the high speed is retracted to the position where it does not contact the sheet $S_2$, while the feed roller 2 is made idle. Subsequently, as shown in FIG. 6C, the following sheet $S_2$ abuts against the control roller 6 remaining in a halt then. As a result, the sheet $S_2$ is temporarily stopped to be synchronized with the start of image formation in response to the output of the register sensor 10. As shown in FIG. 6D, on the start of image formation, the control roller 6 is rotated at the high speed to transport the sheet $S_2$ toward the transport roller 7 while reducing the interval between the sheets $S_1$ and $S_2$ (see also FIG. 7). Thereafter, the control roller 6 is decelerated to coincide with the image forming speed and drives the sheet $S_2$ to the transport roller 7. At this instant, the pick-up roller 1 and feed roller 2 are being rotated at high speed to feed the next sheet $S_3$, thereby preventing the distance between the consecutive sheets from increasing. The transport roller 7 whose rotation corresponds to the image transport of the drum 11 transports the sheet $S_2$ to the image forming section where the drum 11 and image transfer and paper separation unit 12 are located in response to the output of the timing sensor 13.

As shown in FIG. 7, the distance between the sheets is reduced from L5 associated with the step shown in FIG. 6A to L6.

Figure 8A:
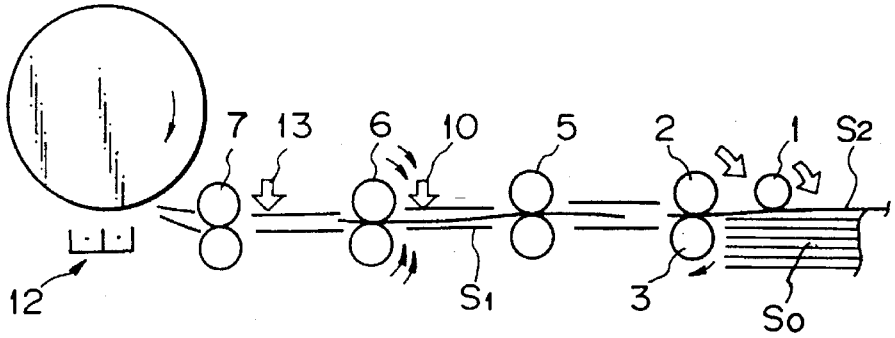
FIGS. 8A, 8B, 8C and 8D are sections showing another alternative embodiment of the invention.
Figure 8B:
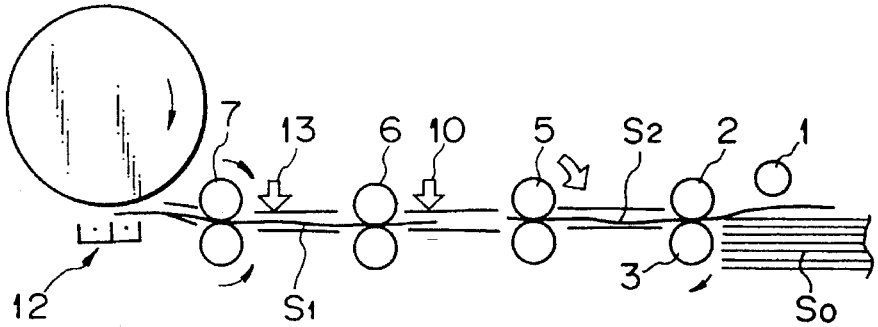

FIGS. 8A–8D show another alternative embodiment of the present invention which drives the rollers located upstream of the control roller 6 at a speed higher than the image forming speed. In the figures, the same or similar constituents to those of FIGS. 6A–6D are designated by the same reference numerals, and the arrows have the previously mentioned meaning. FIG. 9 is a diagram associated with the sequence of steps shown in FIGS. 8A–8D.

This embodiment eliminate the same problem discussed with reference to FIGS. 6A–6D by a different implementation, as follows. As shown in FIG. 8A, after the trailing edge of the sheet $S_1$ fed out from the stack $S_0$ has been fully transported, the uppermost sheet $S_2$ of the stack $S_0$ is fed by the pick-up roller 1 to the feed roller 2 and therefrom to the grip roller 5. Again, the separation roller 3 is applied with a predetermined torque for preventing two or more sheets from being fed together. At this instant, the preceding sheet $S_1$ is being driven at the high speed by the control roller 6. As understood from the previous embodiments, since the sheet $S_1$ is driven at the same speed as the image transport of the drum 11 when it passes the transport roller 7, the pick-up roller 1, feed roller 2 and grip roller 5 transport the sheet $S_2$ at a speed higher than the image transport speed of the drum 11. This allows the distance between the sheets $S_1$ and $S_2$ to be reduced to predetermined one before the trailing edge of the sheet $S_1$ moves away from the transport roller 7.

The transport speed at the sheet feed section is determined by the ratio of the distance between the control roller 6 and the transport roller 7 and the distance between the pick-up roller 1 and the control roller 6 (or grip roller 5), and by the transport speed and the distance between sheets as measured at the image forming section. For example, the sheet transport speed of the transporting means located upstream of the control roller 6 is selected to be (sheet length+sheet distance at the time of sheet feed)/(sheet length+sheet distance at the time of image formation)

times as high as the image forming speed. Of course, such a speed should not be greater than one which causes the following sheet $S_2$ to catch up with the preceding sheet $S_1$. Assume that the transport by the grip roller 5 is also effected at the transport speed assigned to the sheet feed section. Then, when the transport speed of the sheet $S_1$ is lowered to coincide with the image transport speed of the drum 11 as the sheet $S_1$ reaches the transport roller 7, the sheet $S_2$ following the sheet $S_1$ is driven at a higher speed to reduce the distance. At this instant, the pick-up roller 2 is retracted to the position where it does not contact the sheet $S_2$, while the feed roller 2 is made idle.

Figure 8C:
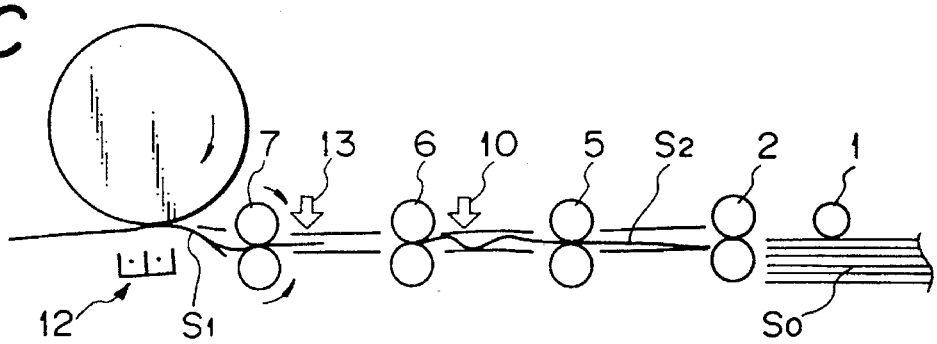
Figure 8D:
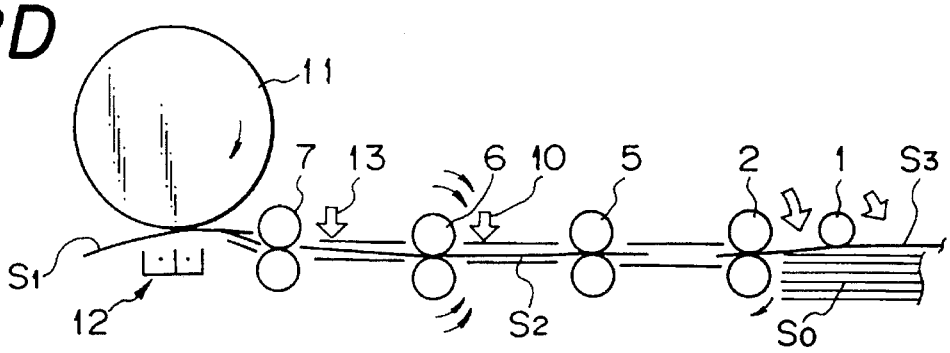
Figure 9:
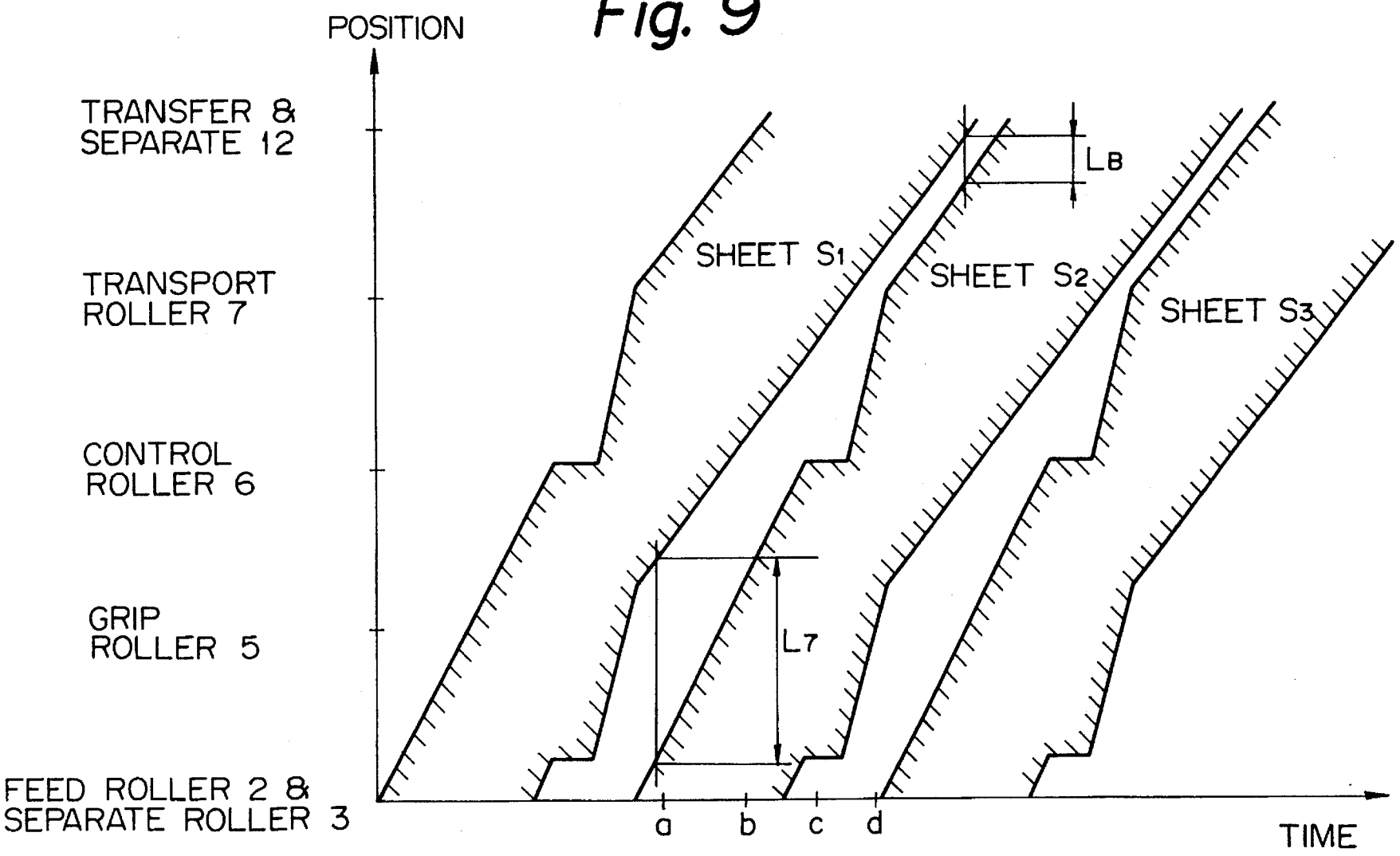
FIG. 9 is a diagram associated with FIGS. 8A–8D.

Subsequently, as shown in FIG. 8C, the subsequent sheet $S_2$ is brought into abutment against the control roller 6 remaining in a halt. As a result, the sheet $S_2$ is stopped for a moment to be synchronized with the start of image formation in response to the output of the register sensor 10. As shown in FIG. 8D, on the start of image formation, the control roller 6 is driven at the high speed to move the sheet $S_2$ toward the transport roller 7 while again reducing the distance between the sheets $S_1$ and $S_2$. Thereafter, the control roller 6 is decelerated to coincide with the image forming speed and drives the sheet $S_2$ to the transport roller 7. The transport roller 7 whose rotation image is associated with the image transport of the drum 11 moves the sheet $S_2$ to the image forming station in response to the output of the timing sensor 13. By such a procedure, the distance between the trailing edge of the sheet $S_1$ and the leading edge of the sheet $S_2$ is reduced from L7 associated with the step of FIG. 8A to L8. During this period of time, the feed roller 2 is driven at the speed assigned to the sheet feed section so as to feed the next sheet.

The construction described above is simple since the pick-up roller 1, feed roller 2 and grip roller 5 are rotated by a single constant-speed drive source via solenoid-operated clutches or similar means.

Figure 10:
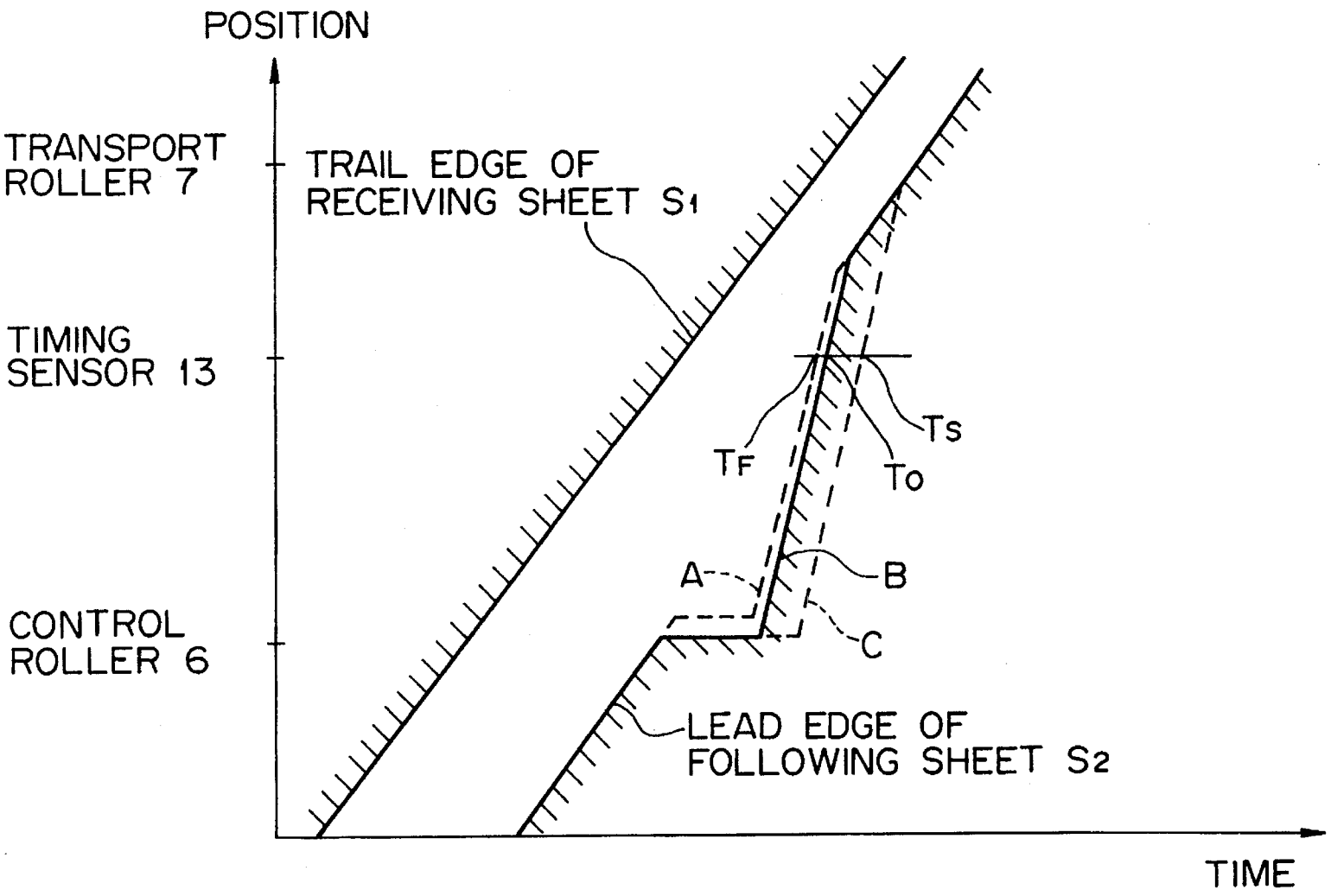
FIG. 10 is a diagram useful for understanding the operation of a timing sensor included in the embodiment of FIGS. 4A–4D.

A reference will be made to FIG. 10 for describing the function of the timing sensor 13 specifically. The transport by the control roller 6 rotating at a high speed is apt to become inaccurate due to slippage ascribable to the loads acting on the upstream rollers and due to the excessive advance of the sheet. In the light of this, as shown in FIGS. 8A–8D by way of example, the timing sensor 13 is located in the vicinity and upstream of the transport roller 7. In FIG. 10, lines B, C and A indicate respectively a usual transport condition, a condition wherein the transport is delayed by slippage or similar cause, and a condition wherein a sheet advances excessively. Then, based on the time To, Ts or Tf when the timing sensor 13 has sensed the leading edge of a sheet, the time for starting deceleration is controlled. As a result, the conditions A, B and C coincide with the same line indicated by a solid line in the figure.

It is to be noted that the above-stated approach for correction is only illustrative and may be replaced with any other suitable one. For example, the transport speed may be changed, or a stop time may be included.

Figure 11:
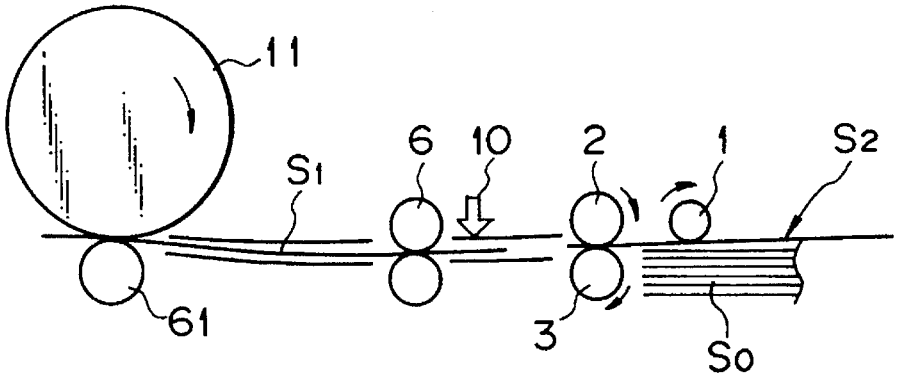
FIGS. 11, 12, 13 and 14 are sections each showing another alternative embodiment of the invention.

FIG. 11 shows another alternative embodiment of the present invention which includes means for maintaining a sheet in close contact with the drum 11 in the event of image transfer. In the figures, the constituents corresponding to those of FIGS. 1A–1D are designated by the same reference numerals.

Generally, in an electrophotographic system, a sheet can be stably transported in an image forming section if the close contact of the sheet and a photoconductive element is enhanced. While in an ordinary transfer charger a sheet and a photoconductive element contact each other due to an electrostatic force, the contact force is apt to become weak when an image carries a great amount of toner. Then, the sheet and the photoconductive element will be dislocated from each other to render the resulting image defective. In the embodiment of FIG. 11, a transfer roller 61 is held in contact with the drum 11 to enhance the close contact of a sheet with the drum 11. Specifically, when the control roller 6 is driven by a stepping motor, the transfer roller 6 prevents the drum 11 and sheet from being dislocated despite that the sheet may slightly oscillate. The transfer roller 61 may be made of rubber or foam urethane having some conductivity and applied with an electric bias to promote the transfer of the toner to a sheet.

Figure 12:
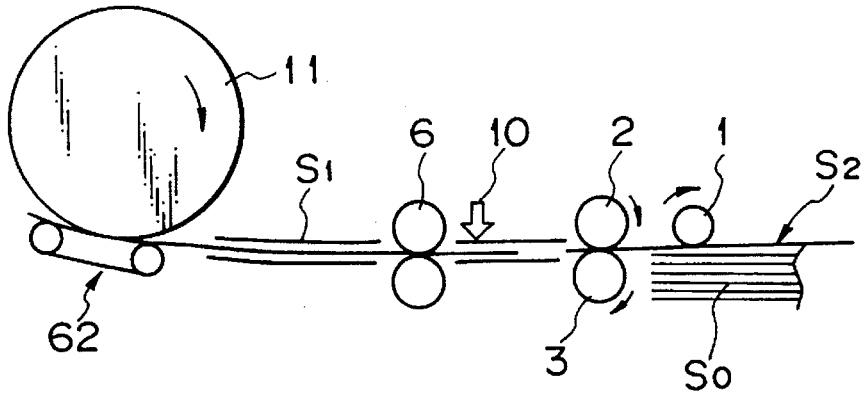

FIG. 12 shows another alternative embodiment similar to the embodiment of FIG. 11 except that the means for urging a sheet against the drum 11 is implemented as a transfer belt 62. It will be seen that the transfer belt 62 is comparable with the transfer roller 61 in respect of the close contact of a sheet with the drum 11. In this embodiment, the transfer belt 62 promotes the transfer of the toner to a sheet by use of a charged dielectric body.

Figure 13:
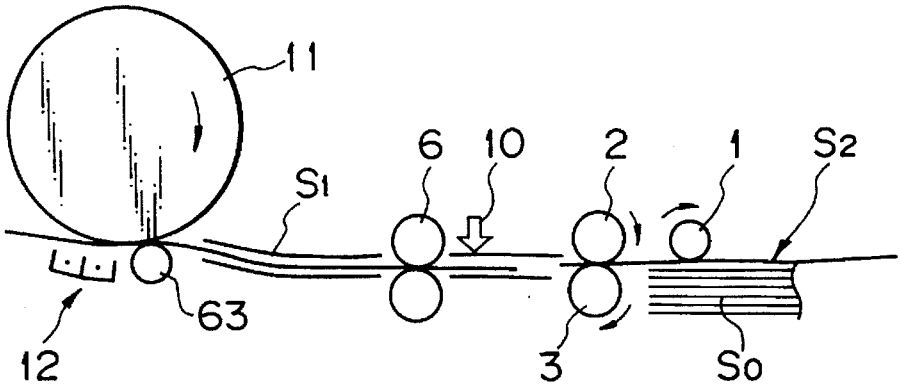

FIG. 13 shows another alternative embodiment also similar to the embodiment of FIG. 11 except that the means for urging a sheet against the drum 11 is implemented as a pinch roller 63. The pinch roller 63 is electrically insulated and does not join in the image transfer, i.e., it is solely used to exert a transporting force. Although not shown in the figure, cleaning means or separating means may be provided in consideration of the direct contact of the drum 11 and pinch roller 63 occurring when a sheet is absent.

Figure 14:
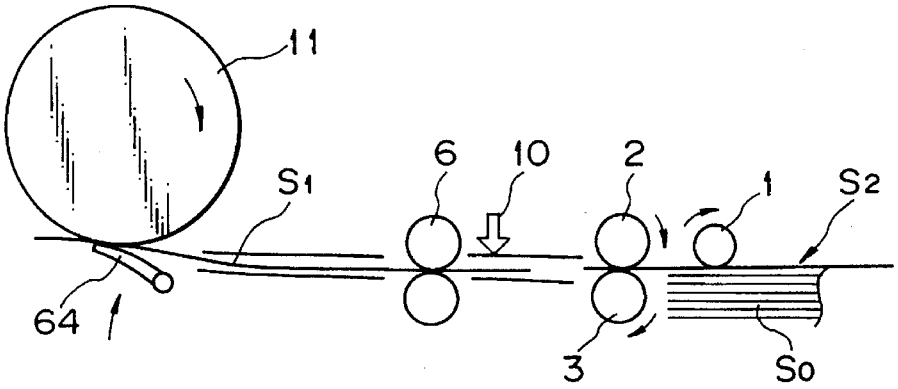

FIG. 14 shows another alternative embodiment also similar to the embodiment of FIG. 11 except that the means for urging a sheet against the drum 11 is implemented as a transfer brush 64. As shown, the transfer brush 64 contacts the surface of the drum 11 when moved as indicated by an arrow in the figure, thereby urging a sheet against the drum 11.

It is to be noted that in the embodiments shown and described the drum 11 is a specific form of a photoconductive element and may be replaced with a belt, if desired.

Figure 15:
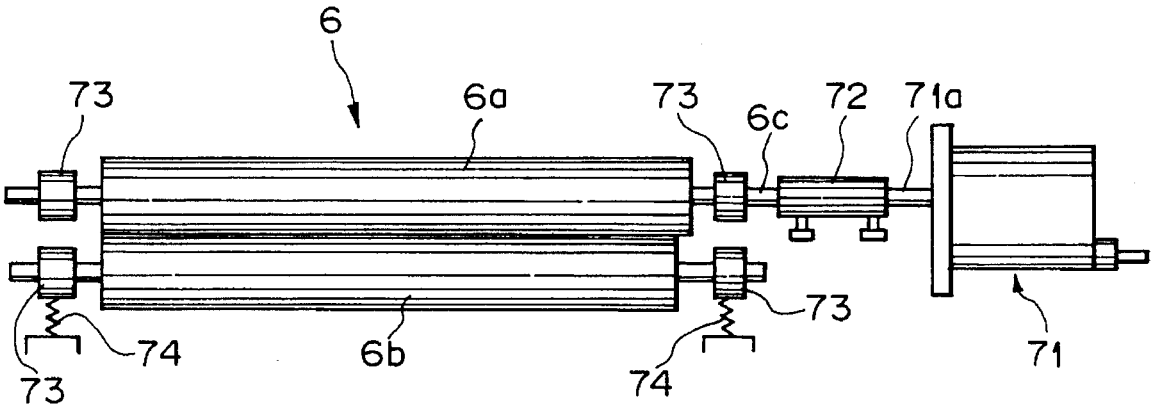
FIG. 15 shows control rollers and a drive line associated therewith for enhancing the accuracy of transport by the control rollers.

FIG. 15 shows the control roller 6 and a drive line associated therewith which are so arranged as to enhance the accurate sheet transfer by the control roller 6. As shown, the control roller 6 is made up of an upper roller **6*a* and a lower roller 6*b*. The rollers 6*a* and 6*b* are each journalled to, for example, opposite side walls of a housing, not shown, by bearings 73. The bearings 73 of the lower roller 6*a* are each constantly biased by a spring 74 toward the upper roller 6*a*. Hence, the rollers 6*a* and 6*b* press against each other with a predetermined pressure adequate for the transport of a sheet. A stepping motor 71 plays the role of a drive source for the control roller 6. Specifically, the output shaft 71*a* of the stepping motor 71 is directly connected to the shaft 6*c* of the upper or drive roller 6*a* by a joint 72**. With this arrangement, it is possible to eliminate back lash particular to a gear train or a timing belt or expansion and contraction particular to a belt and, therefore, to insure accurate sheet transport.

Generally, a stepping motor generates a torque in response to a drive current and moves angularly on the basis of a change in the phase of the drive signal, as well known in the art. Therefore, when a stepping motor is applied to the sheet feeder, it is possible to insure accurate correspondence of the drive signal and rotation angle, to control the driving force by controlling the drive current, and to control the torque in an idle condition.

Figure 16:
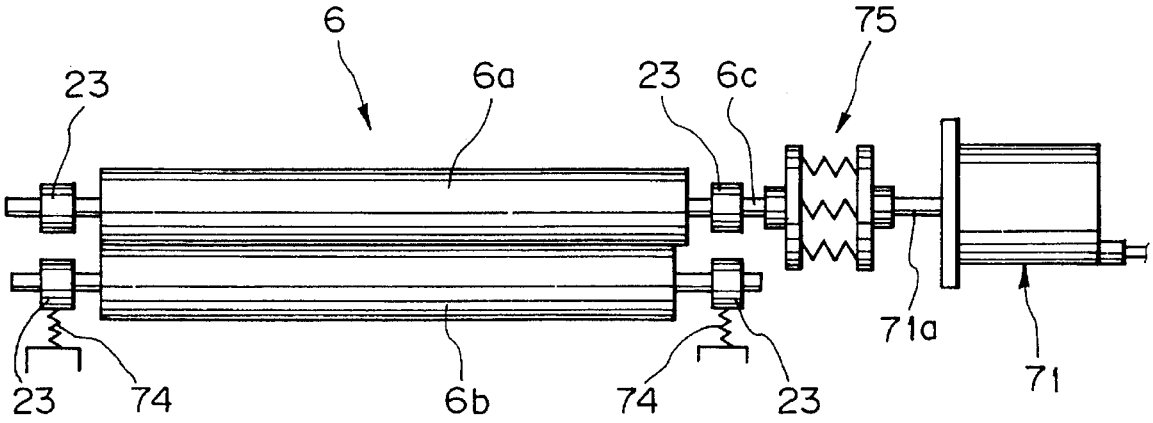
FIGS. 16, 17, 18 and 19 each shows another alternative embodiment of the invention.

FIG. 16 shows another alternative embodiment similar to the embodiment of FIG. 15 except that the shaft **6*c* of the upper roller 6*a* and the output shaft 71*a* of the stepping motor 71 are connected by an elastic coupling 75. The elastic coupling 75 plays the role of vibration reducing means. This kind of arrangement reduces the vibration of a sheet ascribable to the upper and lower rollers 6*a* and 6*b*** by using the inertia of the rollers.

Figure 17:
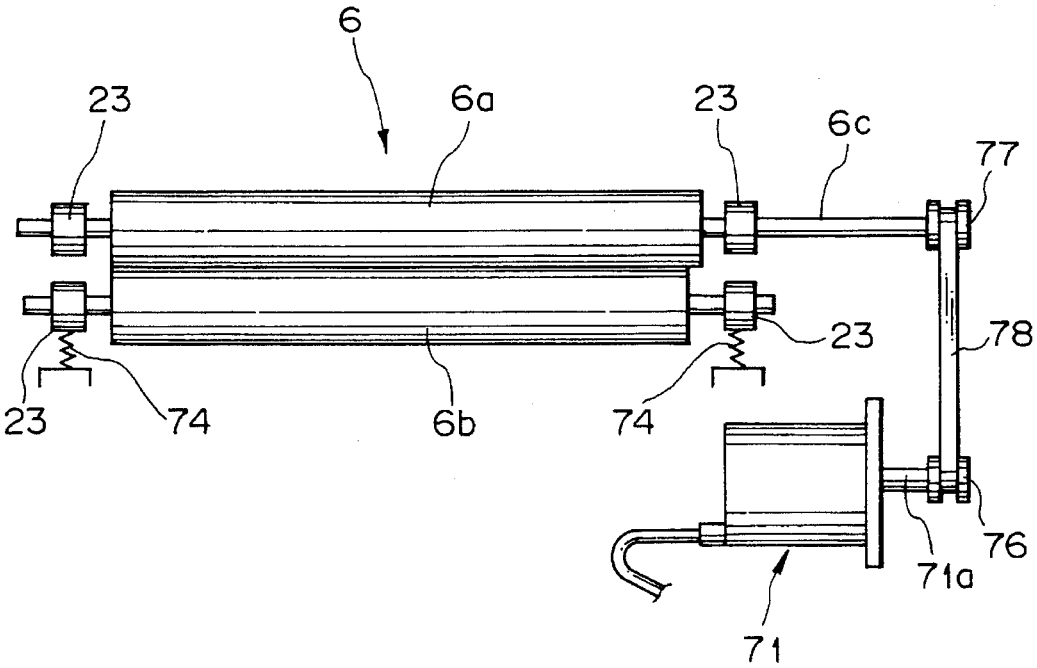

FIG. 17 shows another alternative embodiment similar to the embodiment of FIG. 16 except for the vibration reducing means. As shown, a pulley 76 is affixed to the output shaft **71*a* of the stepping motor 71 while a pulley 77 is affixed to one end of the shaft 6*c* of the control roller 6. A belt 78 is made of rubber and passed over the pulleys 76 and 77. In this case, the vibration is reduced due to the elasticity of the belt 78 and the inertia of the rollers 6*a* and 6*b***.

To increase the inertia of the control roller 6, a flywheel may be mounted on the end of the roller 6. Further, the vibration reducing means shown in FIGS. 16 and 17 are only illustrative and may be replaced with any other suitable one.

Figure 18:
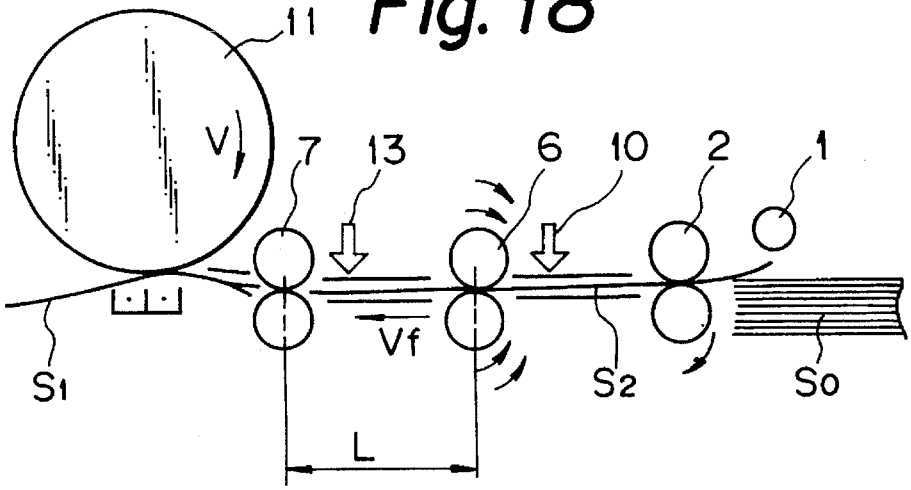

FIG. 18 shows another alternative embodiment similar to the embodiment of FIGS. 4A–4D except that it can control, when the control roller 6 is rotated at the high speed, the transport speed Vf is changed to a speed which reduces the distance between sheets to the limit. To increase the number of images to be formed for a unit time while maintaining the existing sheet transport speed at the image forming section, a sheet distance of 30 millimeters, for example, usually practiced today may be reduced to substantially zero (L4, FIG. 5, to zero) during the course of image formation. For this purpose, it is necessary for the control roller 6 having positioned the leading edge of a sheet while in a halt to drive the sheet toward the image forming section at the high speed Vf matching the transport speed at the image forming section and the distance L between the nip portion of the transport roller 7 and that of the control roller 6.

The transport speed Vf necessary for the distance between the trailing edge of the sheet $S_1$ and the leading edge of the sheet $S_2$ following the sheet $S_1$ to be reduced within the distance L by more than 30 millimeters is produced, as follows. To reduce the distance more than 30 millimeters, the following equations are used:

$$Vf \cdot T(\text{sec}) - V \cdot T(\text{sec}) \geqq 30 \text{ (mm)} \quad (1)$$

$$T = L/Vf \quad (2)$$

where T is the period of time necessary for the leading edge of a sheet being transported at the speed Vf to travel the distance L.

From the equations (1) and (2), T(Vf–V) is greater than or equal to 30 millimeters. Substituting the equation (2) for such a relation, the following equations are obtained:

$$(L/Vf) \cdot (Vf - V) \geqq 30 \text{ (mm)} \quad (3)$$

$$L - L \cdot V/Vf \geqq 30 \text{ (mm)}$$

$$L \cdot V/Vf \leqq L - 30 \text{ (mm)}$$

$$Vf \geqq L \cdot V/(L - 30 \text{ (mm)}) \quad (4)$$

Only if the transport speed Vf of the controller 6 during the high speed transport is determined to satisfy the above equation (4), the distance between the trailing edge of the preceding sheet $S_1$ and the leading edge of the following sheet $S_2$ can be surely reduced by more than 30 millimeters within the distance L. Hence, the most efficient image formation is achievable even if the distance is reduced to zero. This is true with no regard to the transport speed V as measured at the image forming section or to the distance L which may differ from one machine to another.

The embodiment of FIG. 18 includes the transport roller 7 forming part of the image forming section for the purpose of stabilizing the image formation, as described with reference to FIGS. 3A–4D. Therefore, a sheet being transported by the control roller 6 at the high speed is driven at the high speed until it reaches or is about to reach the transport roller 7, and then decelerated to the same speed as the roller 7.

Figure 19:
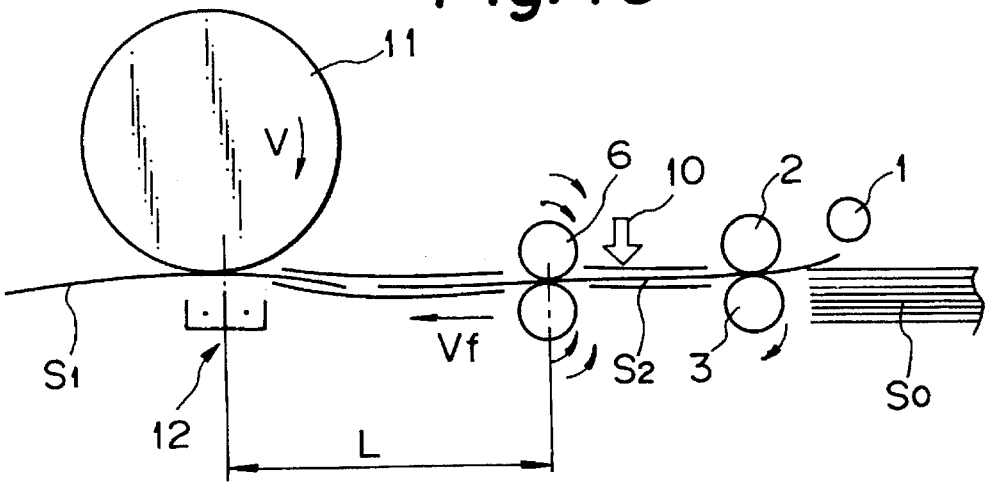

FIG. 19 shows another alternative embodiment similar to the embodiment of FIGS. 1A–1D except that it can control, when the control roller 6 is rotated at the high speed, the transport speed Vf to a speed which reduces the distance between sheets to the limit. In this embodiment, as in the embodiment of FIG. 18, the transport speed Vf of the control roller 6 during the high-speed transport is so selected as to satisfy the equation (4). This insures the most efficient image formation even when the distance between sheets is reduced to zero. In this embodiment, the distance L is the distance between the image transfer position of the image forming section and the nip portion of the control roller 6 since the transport roller 8 is absent.

In the embodiment of FIG. 18, the position where the high speed transfer should be ended, i.e., where the sheet being transported is decelerated to the transport speed of the image forming section may be located to slightly precede the transport roller 7. Also, in the embodiment of FIG. 19, such a position may be located to slightly precede the image transfer position. Then, if the transport speed Vf is made slightly higher than L·V/(L–30 (mm)) to reduce the distance 30 millimeters at the position where the high speed transport ends, the decelerated sheet will be smoothly handed over to the image forming section. This is successful in promoting more stable sheet transfer.

Figure 20:
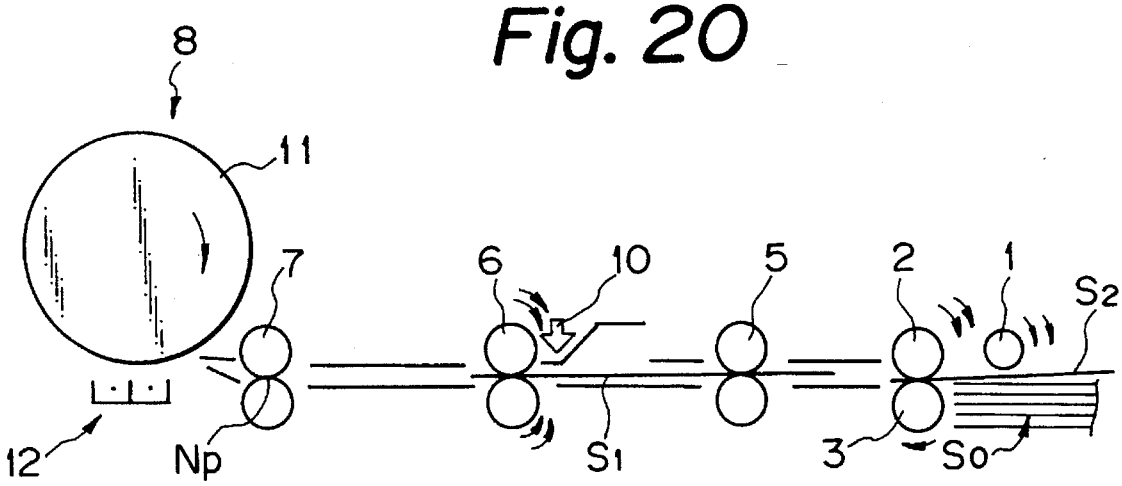
FIG. 20 is a section showing part of an image forming apparatus implemented with the invention extending from a sheet feed section to an image forming section.

FIG. 20 shows an image forming apparatus implemented with another alternative embodiment of the present invention, particularly a sheet feed section to an image forming section thereof. As shown, the image forming apparatus has the drum 11, and the image forming section 8 including the image transfer and paper separation unit 12. The transport roller 7 is made up of a pair of rollers and located upstream (right-hand side as viewed in the figure) of the image forming section 8 in the sheet transport direction. The transport roller 7 is rotated at a speed substantially equal to the transport speed of the image forming section 8. The control roller, or timing roller, 6 is located upstream of the transport roller 7 and constituted by a pair of rollers which are variable in speed. The control roller 6 is driven at a speed higher than the transport speed of the image forming section 8 (drum 11) for a predetermined period of time, thereby reducing the distance between the sheet being transported by the roller 6 and the preceding sheet.

As shown in FIG. 20, the trailing edge of the sheet $S_1$ fed out from the stack $S_0$ has been sufficiently transported, the uppermost sheet $S_2$ of the stack $S_0$ is driven to the feed roller 2 by the pick-up roller 1 and therefrom to the grip roller 5. The separation roller 3 is applied with a predetermined torque in a direction for urging the sheet backward (indicated by an arrow in FIG. 20) to prevent two or more sheets from being fed together. At this instant, since the preceding sheet $S_1$ is being driven at the high speed by the control roller 6, the transport speed of the pick-up roller 1 and feed roller 2 is also made high in matching relation to the sheet $S_1$ in order to prevent the distance from increasing. When the sheet $S_1$ is decelerated to the transport speed identical with the image transport speed of the drum (image forming speed Vp, FIG. 21) by the transport roller 7, the sheet $S_2$ is also decelerated and continuously driven by the grip roller 5. At this time, the pick-up roller 1 having been rotated at the high speed is retracted to the position where it does not contact the sheet $S_2$, while the feed roller 2 is made idle.

Figure 21:
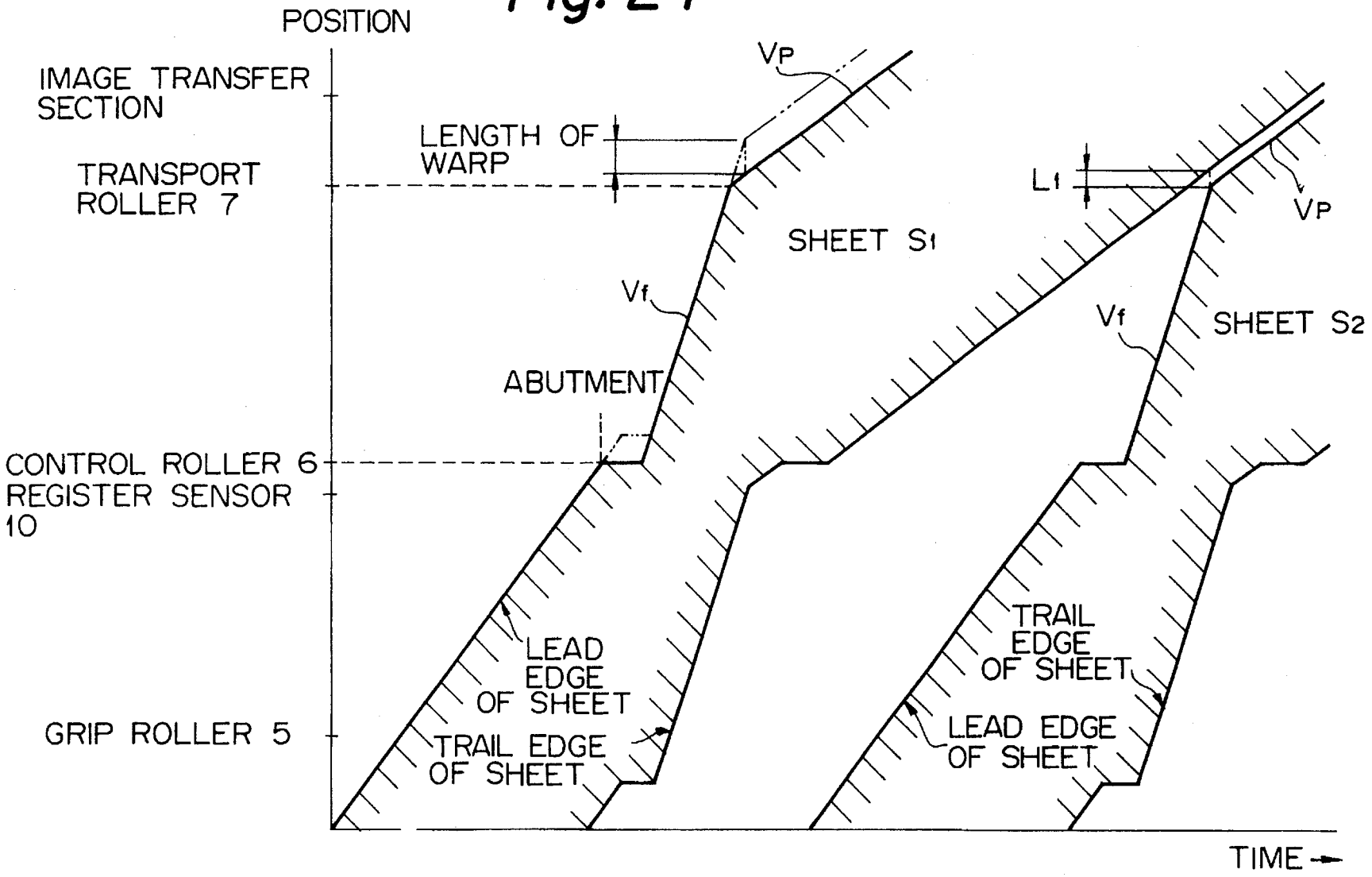
FIG. 21 is a diagram associated with FIG. 20.

Subsequently, as shown in FIG. 21, the following sheet $S_2$ abuts against the control roller 6 which is in a halt then. As a result, the sheet $S_2$ is temporarily stopped to be synchronized with the start of image formation at the image forming section 8 in response to the output of the register sensor 10 (see also FIG. 22). On the start of image formation, the control roller 6 is driven at the high speed Vf so as to reduce the distance between the sheets $S_2$ and $S_1$ while causing the leading edge of the sheet $S_2$ to enter the nip portion Np of the transport roller 7. Thereafter, on the elapse of a predetermined period of time, the control roller 6 is decelerated to the transport speed Vp identical with the image forming speed and continuously transports the sheet $S_2$. At this instant, the pick-up roller 1 and feed roller 2 are further rotated at the high speed to feed the sheet $S_2$, i.e., to prevent the distance from increasing. Subsequently, the transport roller 7 drives the sheet $S_2$ into the image forming section 8.

As shown in FIG. 21, the distance between the preceding sheet $S_1$ and the following sheet $S_2$ is reduced to L1.

Figure 23A:
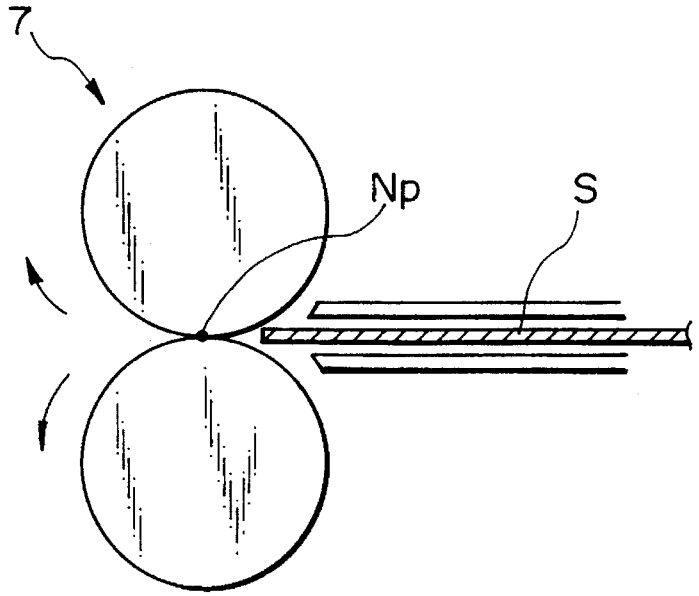
FIGS. 23A and 23B demonstrate how an image position changes relative to a sheet depending on whether or not the leading edge of a sheet is curled.
Figure 23B:
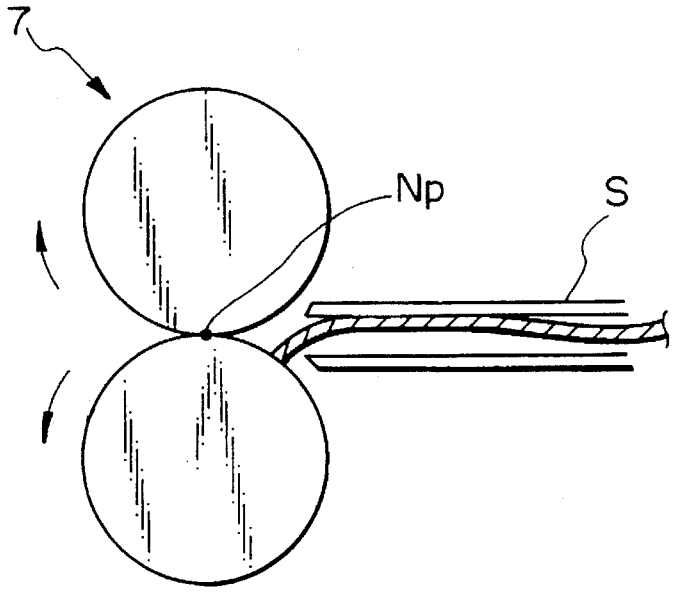

While a sheet is held and transported by the nip portion Np of the transport roller 7, it is likely that the sheet is dislocated in the transport direction, depending on the condition of the leading edge thereof. This will be described with reference to FIGS. 23A and 23B. As shown, the leading edge of a sheet S may enter the nip portion Np of the transport roller 7 with the leading edge thereof remaining straight (FIG. 23A) or with the leading edge thereof curled or otherwise deformed (FIG. 23B). Specifically, in the condition shown in FIG. 23B, the leading edge of the sheet S enters the nip portion Np while sliding on the periphery of one of the rollers (lower roller in the figures) of the transport roller 7. As a result, the time when the transport roller 7 grips and starts driving the sheet S and, therefore, the time when the sheet S reaches the image forming section 8, FIG. 20, slightly differs from the condition of FIG. 23A to the condition of FIG. 23B. Assume that the control roller 6 positions the leading edge of a sheet to synchronize it to the image forming section 8 while correcting the skew of the sheet, and thereafter no synchronizing operations are performed up to the image forming section 8, as in the above-described sheet feeder. Then, the above-stated irregularity will directly translate into the dislocation of an image on the sheet S, resulting in poor image quality.

Figure 22:
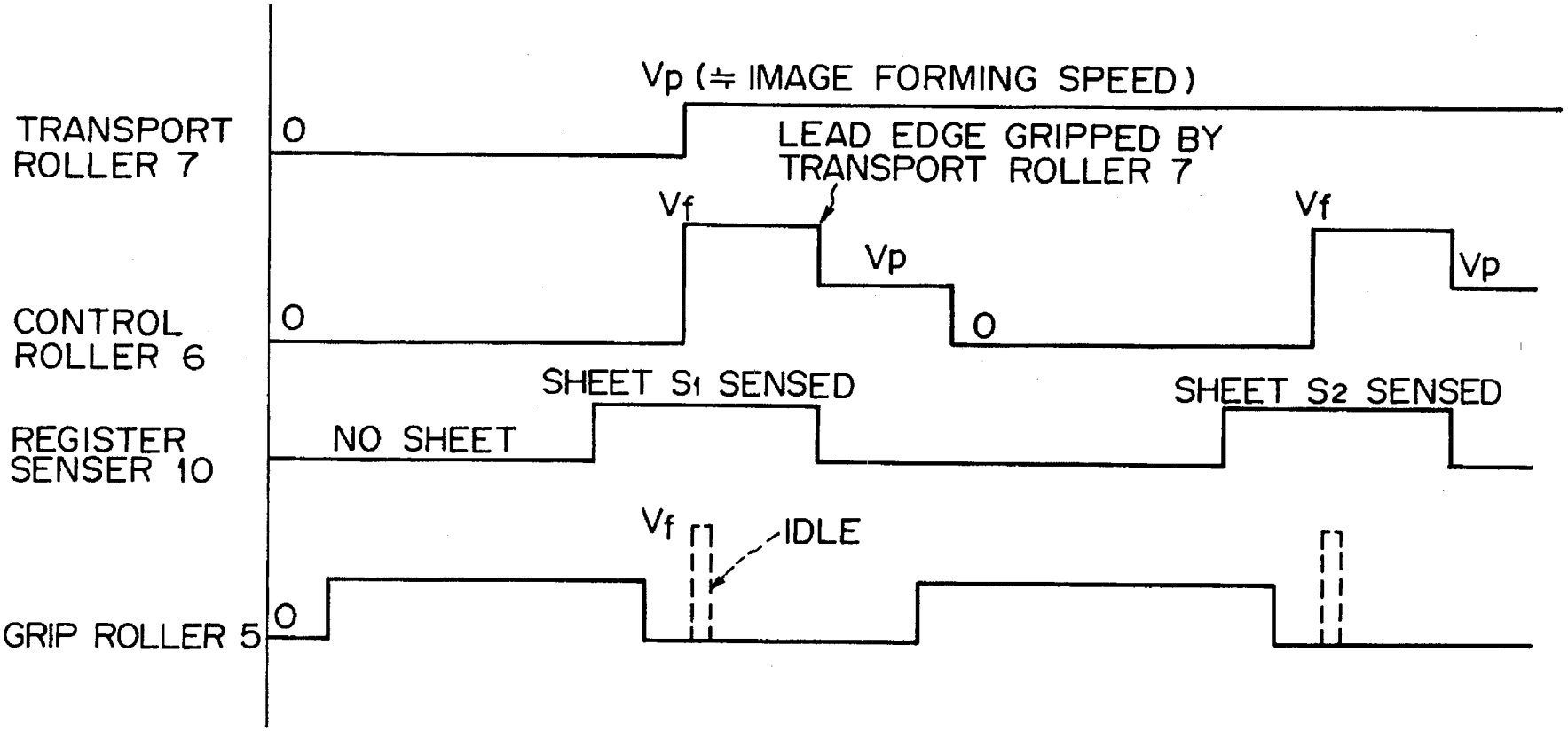
FIG. 22 is a timing chart also associated with FIG. 20.

The embodiment described with reference to FIGS. 20–22 is free from the above occurrence. Specifically, the control roller 6 rotating at the high speed transports a sheet to the transport roller 7. After the transport roller 7 has gripped the leading edge of the sheet, the control roller 6 is decelerated to the speed substantially equal to the transport speed of the image forming section 8. As a result, the sheet enters the nip portion Np of the transport roller 7 while being transported at the high speed. It follows that even when the leading edge of the sheet is curled as shown in FIG. 23B, it is immediately driven into the nip portion Np along the roller surface. This reduces the irregularity in the interval between the time when the control roller 6 is rotated at the high speed and the time when the leading edge of the sheet S is surely gripped by the nip portion Np of the transport roller, thereby reducing the deviation of an image relative to the sheet S. Since the distance between the trailing edge of the sheet $S_1$ and the leading edge of the sheet $S_2$ can be reduced to minimum necessary one (L1, FIG. 21) due to the high speed transport of the sheet $S_2$ by the control roller 6, high speed transfer is implemented which allows a great number of images to be formed for a unit time.

It is to be noted that the time when the transport speed of the control roller 6 is to be decelerated to a speed substantially equal to the sheet transport speed of the image forming section 8 has to be so determined as to prevent the sheet from bending at the time of deceleration.

Figure 24:
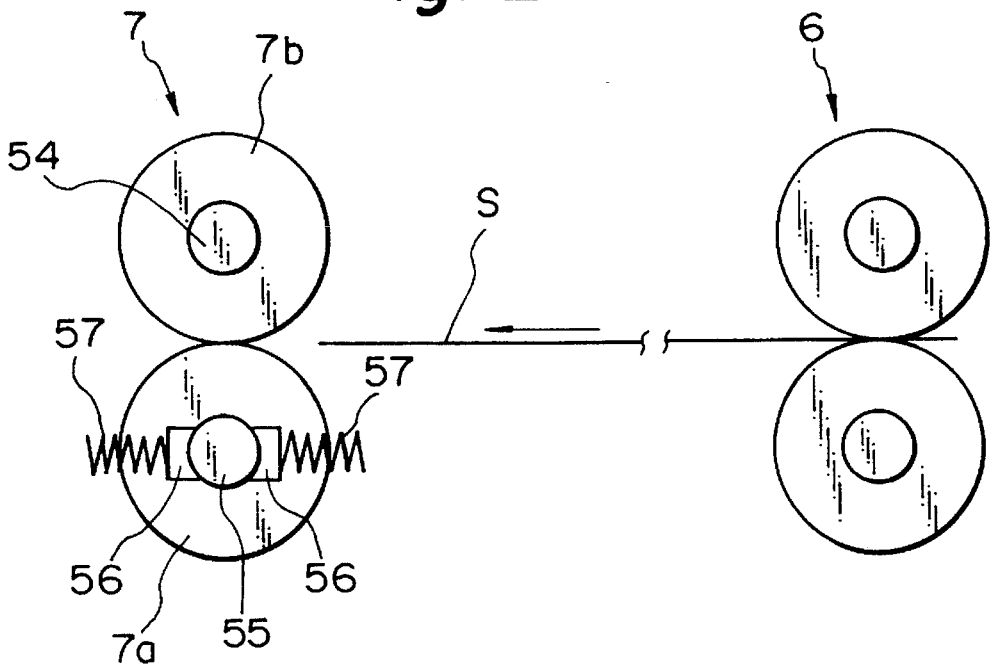
FIGS. 24 and 25 each shows a specific arrangement for preventing a transport roller from rotating when a sheet abuts thereagainst.

In the embodiment of FIG. 20, while the transport roller 7 has a predetermined transport speed substantially equal to the transport speed Vp of the image forming section 8, a sheet being transported at a transport speed Vf higher than that of the roller 7 abuts against the roller 7. Assume that the roller 7 is driven via a gear train. Then, when the sheet abuts against the roller 7, the roller 7 is apt to rotate an angle corresponding to the backlash of the gear train due to the elasticity of the sheet. In such a case, the sheet and, therefore, an image to be formed thereon will be dislocated in the transport direction. FIG. 24 shows a specific arrangement for preventing the roller 7 from rotating when the sheet abuts thereagainst.

As shown in FIG. 24, the lower roller 7*a* of the transport roller 7 is supported by a shaft 55 at the axis thereof. Brake pads or similar brake members 56 for suppressing the rotation of a shaft are slidably pressed against opposite sides of the shaft 55 by respective springs 57. When the sheet S being transported at the high speed abuts against the transport roller 7, the brake members 56 prevent the shaft 55 from being easily rotated (slight rotation due to the backlash) by friction. Hence, even when the roller shaft 55 is driven via a gear train, it is prevented from rotating when the sheet S hits against the roller 7 due to the frictional resistance directly acting on the shaft 55. This enhances accurate registration and reduces the dislocation of an image relative to a sheet.

Despite that the mechanism for regulating the rotation of the shaft 55 is associated only with the lower roller 7*a*, as shown in FIG. 24, the transport roller 7 is successfully prevented from being rotated since the upper roller 7*b* is pressed against the lower roller 7*a* by a predetermined force. However, such a mechanism may also be associated with a shaft 54 supporting the upper roller 7*b*, if desired.

Figure 25:
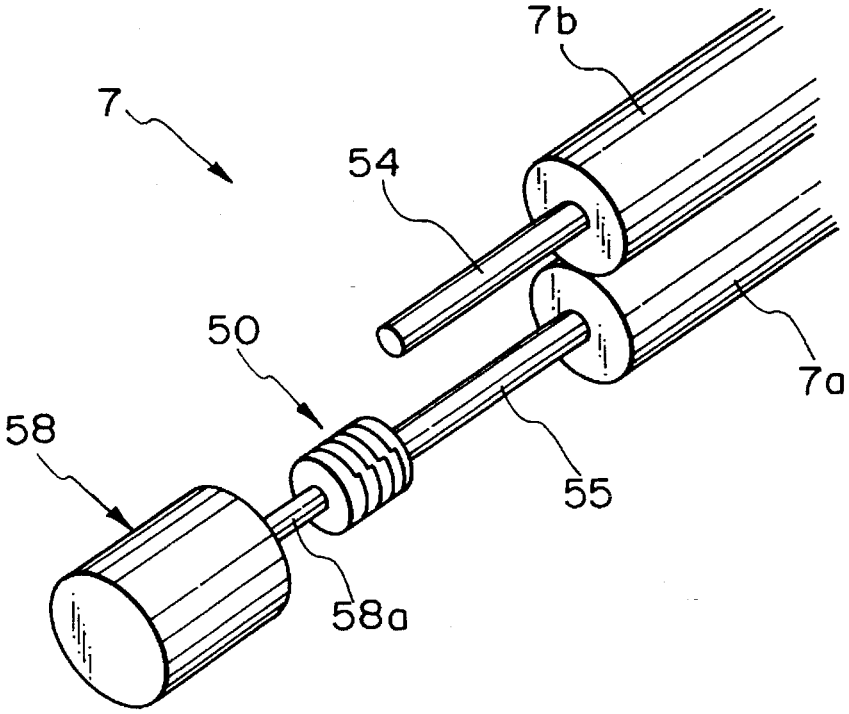

FIG. 25 shows another specific arrangement for eliminating the slight rotation of the transport roller 7 stated above. As shown, the shaft 55 supporting the lower roller 7*a* is directly connected to the output shaft 58*a* of a motor 58 by a coupling 50. The torque of the motor 58 is selected such that when the sheet S being transported at the high speed by the control roller 6 (see FIG. 24) hits against the transport roller 7, the motor 58 does not rotate (slightly rotate) despite the resulting impact.

Figure 26A:
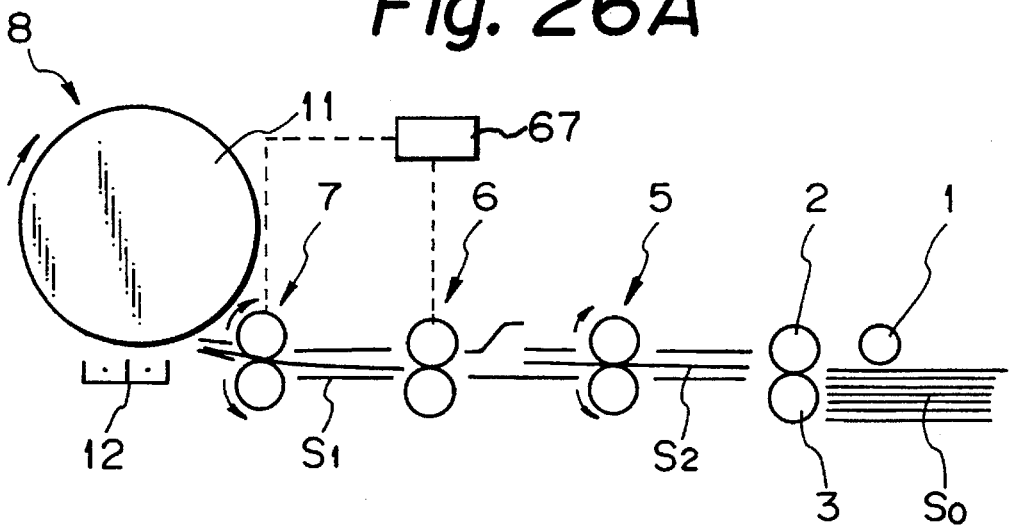
FIGS. 26A, 26B and 26C show another alternative embodiment of the invention at a sequence of stages of operation.
Figure 26B:
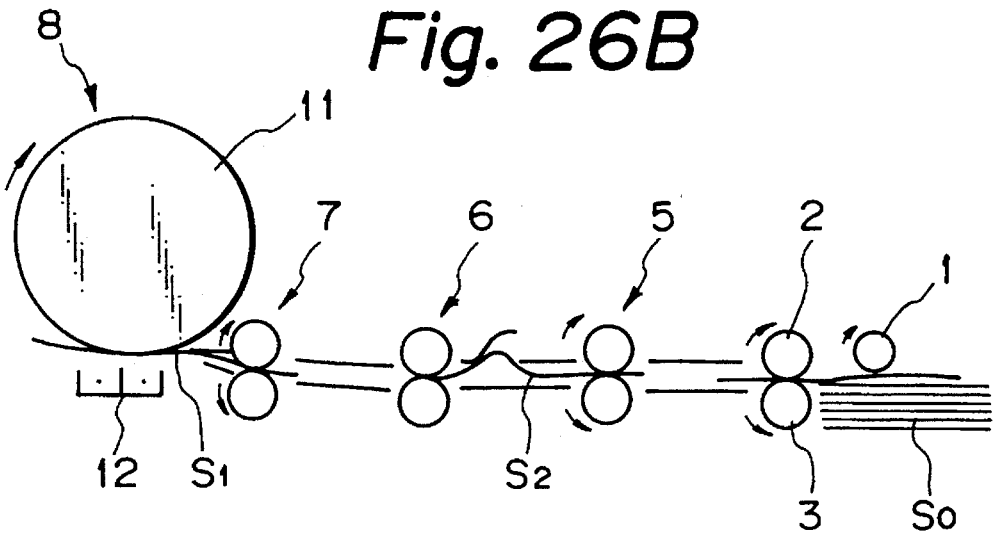
Figure 26C:
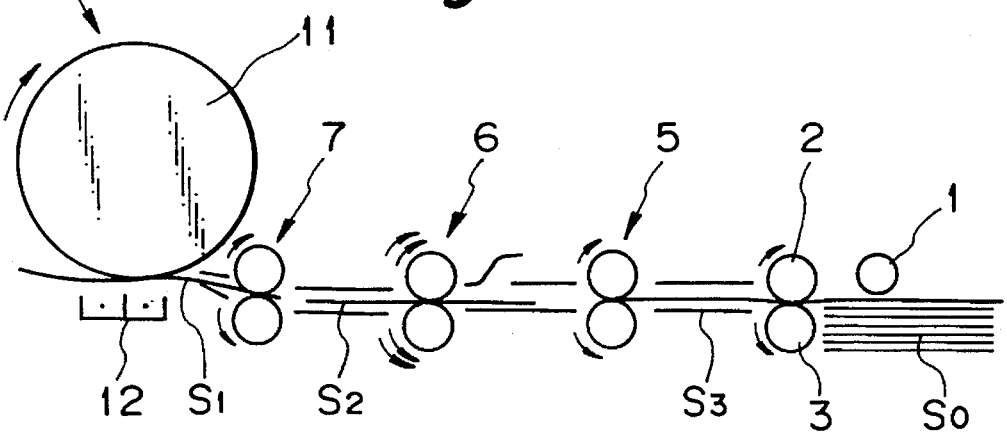
Figure 27A:
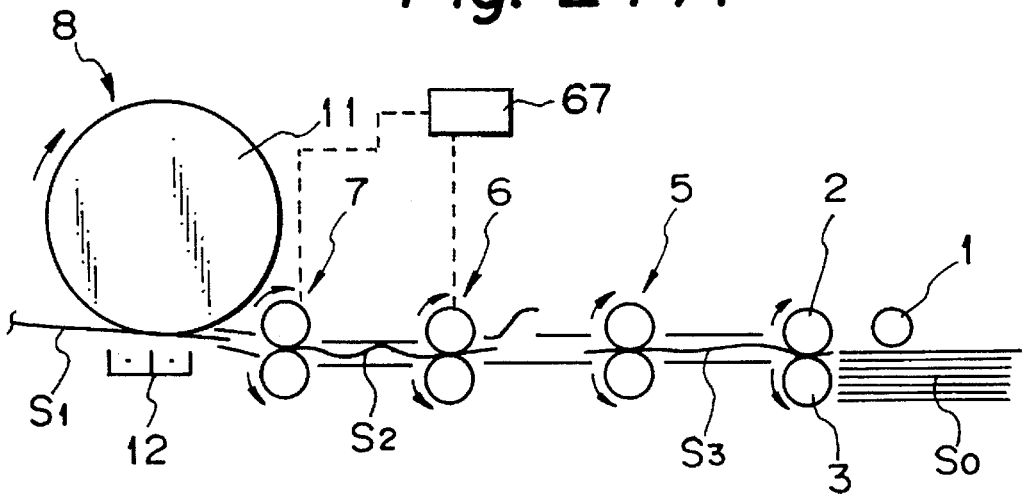
FIGS. 27A, 27B and 27C are views also pertaining to the embodiment of FIGS. 26A–26C.

Referring to FIGS. 26A–26C, 27A–27C and 28, another alternative embodiment of the present invention will be described. Generally, this embodiment is so constructed as to cut off the drive acting on the control roller 6 to make it idle before the leading edge of a sheet reaches the image forming section 8. Schematically illustrated in FIG. 26A and FIG. 27A is a control means 67 which can control the speed of the control roller 6 and the transport roller 7.

Figure 27B:
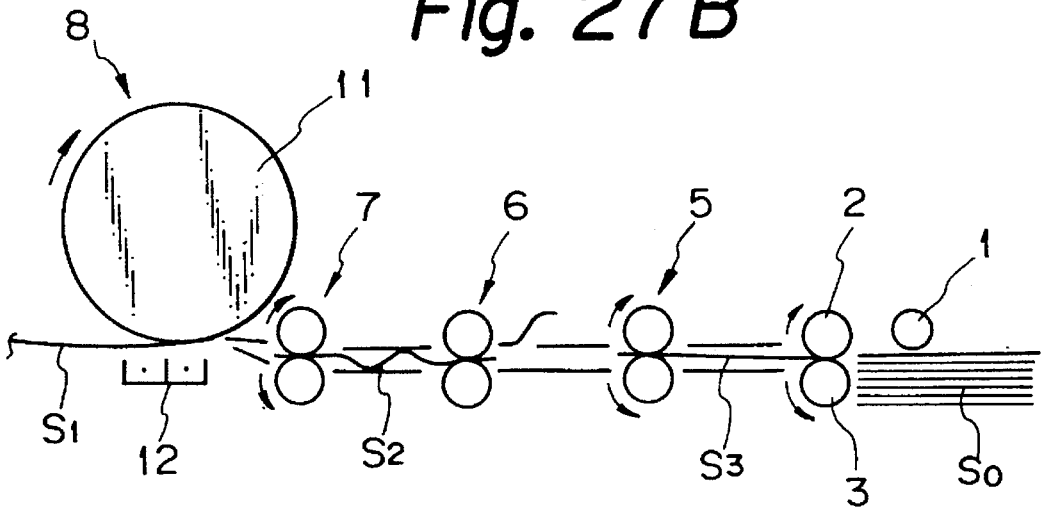

Specifically, as shown in FIG. 27B, the transport roller 7 grips the leading edge of the sheet S2 to decelerate it to the speed substantially equal to the transport speed of the image forming section 8. Then, before the leading edge of the sheet S2 reaches the position between the drum 11 and the image transfer and paper separation unit 12, the drive of the control roller 6 is cut off to make it idle.

Figure 28:
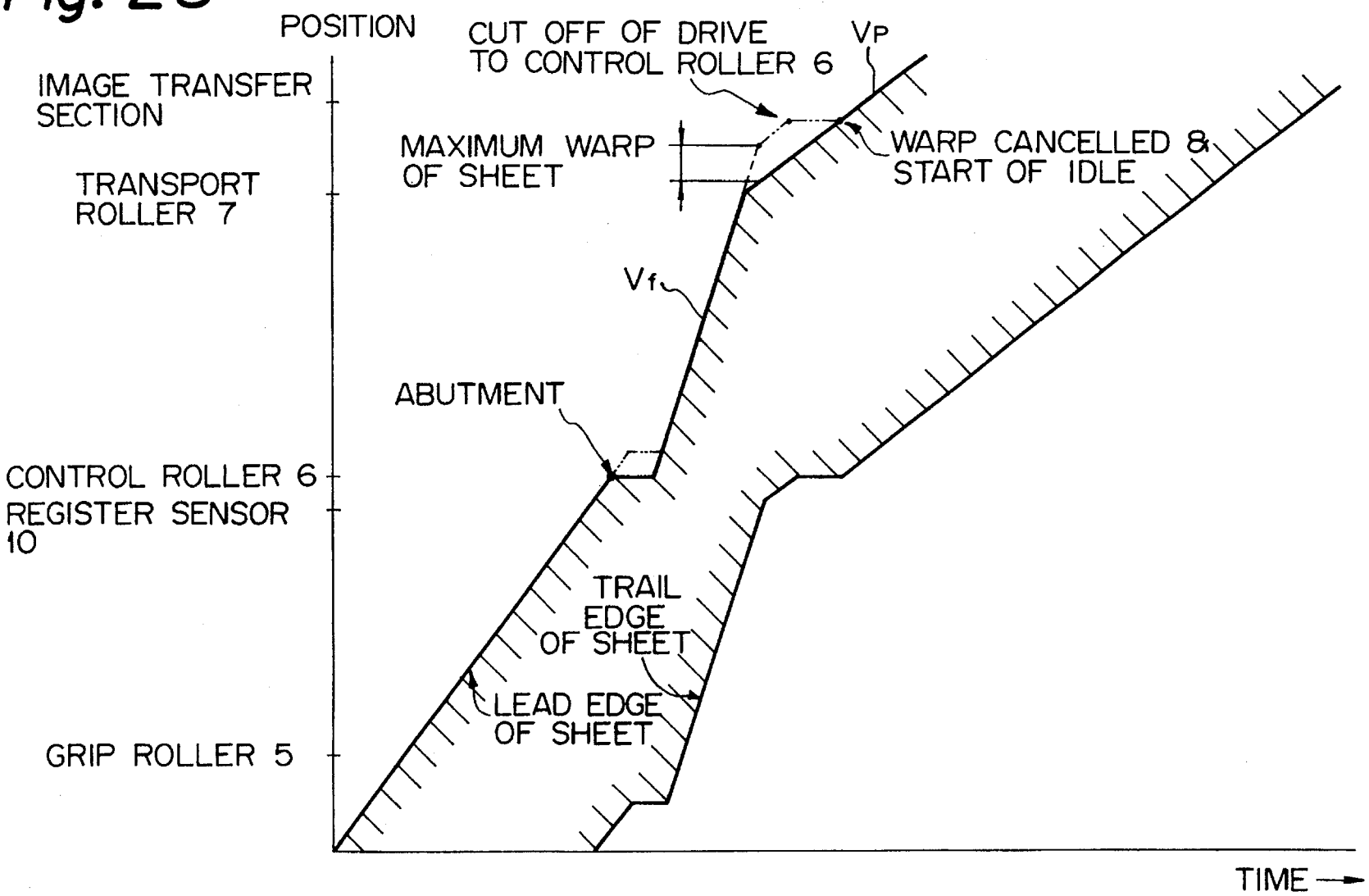
FIG. 28 is a diagram associated with the embodiment of FIGS. 26A–26C and 27A–27C.

More specifically, as shown in FIG. 26A, after the first sheet $S_1$ has been fed out, the second sheet $S_2$ is fed out by the pick-up roller 1, separated from the others by the feed roller 2 and separation roller 3, driven to the grip roller 5, and then transported to the control roller 6. Driven by a stepping motor, for example, the control roller 6 is rotatable at a variable speed. As shown in FIG. 26B, as the leading edge of the sheet $S_2$ abuts against the control roller 6 which is in a stop, it deforms to be positioned and has the skew corrected, as illustrated (see also FIG. 28). Subsequently, as shown in FIG. 26C, the control roller 6 again starts rotating in synchronism with the toner image formed on the drum 11 to thereby transport the sheet S2. At this instant, the control roller 6 is accelerated to the transport speed Vf higher than the transport speed Vp of the image forming section 8 for a predetermined period of time, as shown in FIG. 28. As a result, the distance between the sheet $S_2$ transported at the high speed and the preceding sheet $S_1$ (in transport at the speed Vp) is reduced, as shown in FIG. 26C.

As shown in FIG. 27A, as the leading edge of the sheet $S_2$ being transported at the high speed is introduced in and gripped by the nip portion of the transport roller 7 rotating at the speed substantially equal to the speed Vp of the image forming section 8, the control roller 6 is decelerated to a speed substantially equal to the speed Vp. When the leading edge of the sheet $S_2$ hits against the transport roller 7, it deforms due to the difference between the high speed Vf and the usual speed Vp, as illustrated. As soon as the trailing edge of the sheet $S_2$ is decelerated by the transport roller 7 to the speed substantially equal to transport speed Vp of the image forming section 8, the drive of the control roller 6 is cut off to make it idle before the leading edge of the sheet $S_2$ reaches the position between the drum 11 and the image transfer and sheet separation unit 12, as shown in FIG. 27B.

Figure 27C:
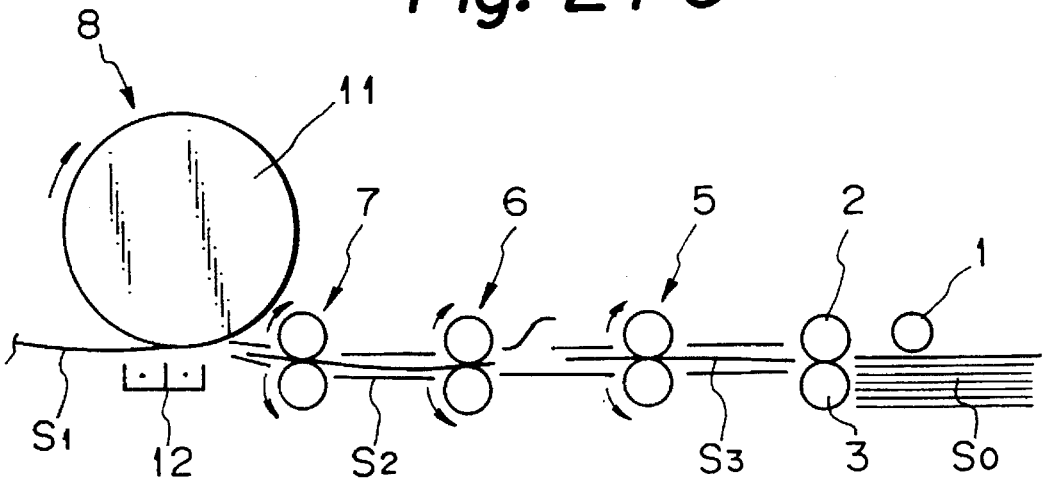

However, even when the drive of the control roller 6 is cut off, the roller 6 does not immediately become idle and is brought to a halt for a moment due to the deformation existing at the leading edge of the sheet $S_2$. As shown in FIGS. 27C and 28, as the leading edge of the sheet $S_2$ is sequentially transported by the transport roller 7, the deformation decreases to zero. Then, the control roller 6 in the idle state is rotated by the sheet $S_2$. At the time when the control roller 6 begins to be rotated by the sheet $S_2$, the leading edge of the sheet $S_2$ has not reached the image transfer position yet, as shown in FIG. 27C. Therefore, at such a moment, an impact abruptly acts on the sheet $S_2$ being transported due to the inertia of the control roller 6. As a result, despite that the sheet $S_2$ is surely gripped by the transport roller 7, the impact will cause black stripes to appear or otherwise lower the image quality if the leading edge of the sheet $S_2$ has already reached the image transfer position and is undergoing image transfer. The fall of image quality ascribable to such an occurrence can be eliminated if the leading edge of the sheet $S_2$ is prevented from reaching the image transfer position at the instant when the control roller 6 begins to be rotated by the sheet $S_2$.

Figure 29:
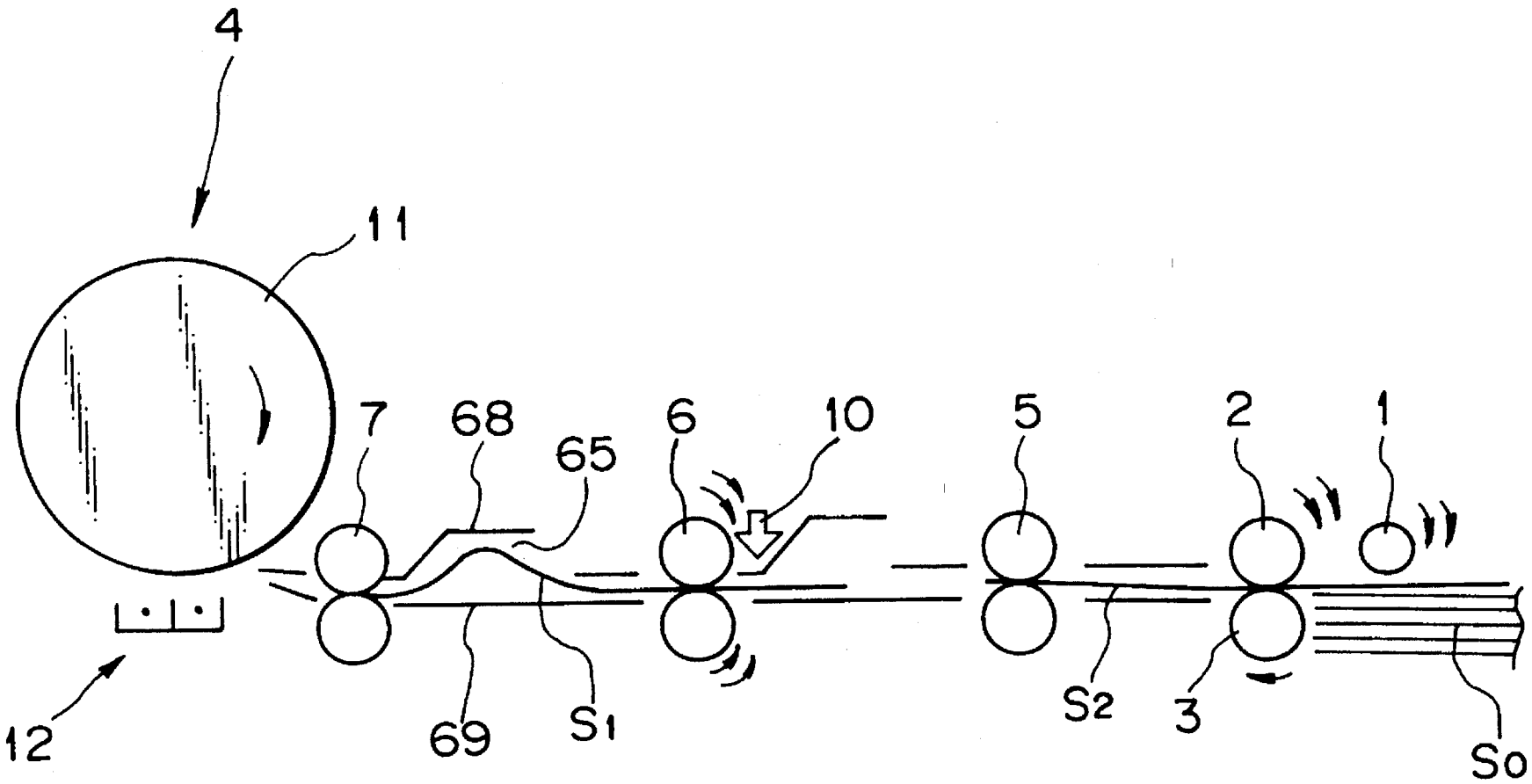
FIG. 29 shows another alternative embodiment of the invention.

FIG. 29 shows still another alternative embodiment of the present invention. As shown, an upper guide plate 68 and a lower guide plate 69 extend between the control roller 6 and the transport roller 7 for defining a sheet transport path. The upper guide plate 68 is provided with an expanded portion 65 for accommodating the deformation or warp of the sheet occurring when the sheet abuts against the transport roller 7. Specifically, the upper guide plate 68 is bent upward, as viewed in FIG. 29, to increase the width of the transport path, thereby forming the expanded portion 65. The expanded portion 65 receives the warp of the sheet $S_2$ ascribable to the difference between the speed of the control roller 6 and that of the transport roller 7, as described with reference to FIG. 27A.

In the above construction, when the sheet $S_2$ is transported toward the transport roller 7, the leading edge thereof abuts against the roller 7 since the transport speed of the control roller 6 is higher than that of the transport roller 7. Hence, the skew of the sheet $S_2$ can be corrected even at the portion where the transport roller 7 is located. Since the warp of the sheet $S_2$ is accommodated in the expanded portion 65, the sheet $S_2$ can have the leading edge thereof positioned and and have the skew corrected. This further enhances the quality of the resulting image.

In summary, the present invention achieves various unprecedented advantages, as enumerated below.

(1) The distance between two consecutive sheets is reduced to a minimum necessary one. This insures efficient image formation by eliminating wasteful image forming operations ascribable to a great distance between sheets. Hence, not only the life of each constituent of an image forming system is increased, but also the number of images to be formed for a unit time is increased without resorting to a higher image forming speed. It follows that the running cost is reduced, and the increase in noise and the increase in power consumption are suppressed. In addition, since a transport roller is absent between an image forming section and a control roller, the number of parts and, therefore, the cost is reduced as well as the overall dimensions of an apparatus.

(2) Regarding the transfer of a toner image from a photoconductive element to a sheet, means is provided in the image forming section for causing the sheet to closely contact the photoconductive element. Hence, the sheet contacts the photoconductive element closely enough to be free from vibration ascribable to the control roller, insuring high quality images.

(3) The minimum necessary distance between the sheets is also achievable in the case of an apparatus of the type having a long transport path between a sheet feed section and an image forming section.

(4) Since the registration is effected by the control roller, a reliable sheet feeder can be implemented with a simple construction and at low cost.

(5) Even when a sheet slips on the control roller while being transported, a dislocation due to the slippage can be corrected. This maintains the minimum necessary distance between the sheets with desirable accuracy.

(6) The control roller is driven by a stepping motor, and the output shaft of the motor and the shaft of the control roller are directly connected to each other. This eliminates back lash particular to a gear train or expansion and contraction particular to a belt and, therefore, enhances reliability.

(7) The output shaft of the stepping motor and the shaft of the control roller are connected by vibration reducing means, so that vibration is reduced by using the inertia of the control roller. Hence, high quality images can be formed even if a transport roller is not interposed between the image forming section and the control roller.

(8) While the control roller grips the following sheet and transports it at a high speed, the distance between the following sheet and the preceding sheet can be surely reduced by more than 30 millimeters. Therefore, by reducing the distance to the limit, it is possible to form images most efficiently. In addition, the operation time of each portion of the image forming section is reduced to increase the life while noise and power consumption are suppressed.

(9) Even when the leading edge of a sheet is slightly deviated from the nip portion of the transport roller due to, for example, a curl during the high speed transport, the leading edge can be immediately brought to the nip portion. This reduces irregularity in the interval between the time when the control roller is driven at the high speed and the time when the leading edge of a sheet being transported by the control roller is surely gripped by the nip portion of the transport roller. As a result, the dislocation of an image relative to a sheet is reduced despite the continuous and high-speed transport of sheets.

(10) The drive acting on the control roller is cut off to make it idle before the leading edge of a sheet decelerated to a speed substantially equal to the image forming speed reaches the image forming section. Hence, the leading edge of the sheet has not reached the image forming section at the instant when the control roller has been made idle. It follows that although an impact may abruptly act on the sheet being transported due to the inertia of the roller when the control roller starts being idle, an image has not been formed at that moment yet. Therefore, images are tree from black stripes and other defects.

(11) A guide member defining a transport path between the control roller and the transport roller is provided with an expanded portion. When a sheet is transported toward the transport roller, the control roller is rotated at a higher speed than the transport roller. Hence, as the leading edge of the sheet hits against the transport roller, it deforms due to the difference in speed between the two rollers. The deformed portion of the sheet is received in the expanded portion of the guide member. This is successful in positioning the leading edge of the sheet and correcting the skew of the sheet with ease, further enhancing the quality of images.

Various modifications will become possible for those skilled in the art after receiving the teachings of the present disclosure without departing from the scope thereof.

What is claimed is:

1. A sheet feeder for continuously feeding cut sheets to an image forming section of an image forming apparatus, comprising:

control rollers adjoining the image forming section on an upstream side of the image forming section with respect to an intended direction of sheet transport for transporting the sheets to said image forming section at a desired transport speed;

control means for accelerating said control rollers to a first speed higher than an image forming speed for a desired period of time after a leading edge of the sheet has been gripped by said control rollers and reducing the speed of said control rollers from said first speed to said sheet processing speed before said leading edge of the sheet reaches the image forming section to thereby reduce a distance between a preceding sheet and a succeeding sheet, said control means further controlling said control rollers to stop or start rotating in synchronism with a rotation of a photoconductive element of the image forming section; and a transport roller located upstream of the image forming section and downstream of said control rollers with respect to the intended direction of sheet feed and rotatable at a transport speed substantially equal to a transport speed of said image forming section, wherein said transport roller decelerates a speed of the sheet transported by the control rollers when the transport roller grips the leading edge of the sheet, said control means controlling said transport roller and said control rollers such that after the leading edge of the sheet transported by said control rollers rotating at the high speed has been gripped by said transport roller, the transport speed of said control rollers is reduced to one substantially equal to the transport speed of said image forming section.

2. A sheet feeder as claimed in claim 1, wherein the image forming section comprises a photoconductive element for forming an image thereon, said sheet feeder further comprising means disposed in said image forming section for causing, when an image formed on said photoconductive element is to be transferred to the sheet being transported, said sheet to closely contact said photoconductive element.

3. A sheet feeder as claimed in claim 1, further comprising sheet transporting means located upstream of said control rollers with respect to the intended direction of sheet transport, said control means controlling said sheet transporting means such that while said control rollers are rotated at the high speed, a transport speed of said transporting means is also increased.

4. A sheet feeder as claimed in claim 1, further comprising sheet transporting means located upstream of said control rollers with respect to the intended direction of sheet feed and having a transport speed which is (sheet length+sheet distance at the time of sheet feed)/(sheet length+sheet distance at the time of image formation)

times as high as the image forming speed.

5. A sheet feeder as claimed in claim 1, wherein said control means controls said control rollers such that after said control rollers have been brought to a stop, the leading edge of the sheet is abutted against a nip portion of said control rollers for registration, and thereafter transport of said sheet is resumed.

6. A sheet feeder as claimed in claim 1, further comprising sheet sensing means interposed between the image forming section and said control rollers for sensing the sheet, said control means adjusting a transporting movement of said control rollers in response to an output of said sheet sensing means.

7. A sheet feeder as claimed in claim 1, further comprising a drive source implemented by a stepping motor for driving said control rollers, an output shaft of said stepping motor and a shaft of said control rollers being directly connected to each other.

8. A sheet feeder as claimed in claim 1, further comprising a drive source implemented by a stepping motor for driving said control rollers, and vibration reducing means for connecting an output shaft of said stepping motor and a shaft of said control rollers.

9. A sheet feeder as claimed in claim 1, wherein assuming that a transport speed at the image forming section is V, a distance between said image forming section and a nip portion of said control rollers is L, and a transport speed of said control rollers being rotated at the high speed while gripping the sheet is Vf, said transport, speed Vf satisfies a relation:

$$Vf \geqq L \cdot V/(L-30 \text{ (millimeters)}).$$

10. A sheet feeder as claimed in claim 1, wherein said control means controls said transport roller and said control rollers such that before the leading edge of the sheet gripped by said transport roller reaches the image forming section after the decrease of the transport speed to the one substantially equal to the transport speed of said image forming section, a drive acting on said control rollers is cut off to make said control rollers idle.

11. A sheet feeder as claimed in claim 1, further comprising a guide member forming a sheet transport path between said control rollers and said transport roller and including an expanded portion for receiving a leading edge portion of the sheet which deforms on abutting against said transport roller.

* * * * *